US008669909B2

(12) United States Patent
Yamaguchi et al.

(10) Patent No.: US 8,669,909 B2
(45) Date of Patent: Mar. 11, 2014

(54) ANTENNA, ANTENNA APPARATUS, AND COMMUNICATION APPARATUS

(71) Applicant: Panasonic Corporation, Osaka (JP)

(72) Inventors: Shuichiro Yamaguchi, Miyazaki (JP); Tatsuya Yanagida, Miyazaki (JP); Yasutaka Hieda, Miyazaki (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/687,277

(22) Filed: Nov. 28, 2012

(65) Prior Publication Data

US 2013/0135165 A1 May 30, 2013

(30) Foreign Application Priority Data

Nov. 30, 2011 (JP) ..... 2011-261414
Dec. 28, 2011 (JP) ..... 2011-288451
Aug. 9, 2012 (JP) ..... 2012-177027

(51) Int. Cl.
*H01Q 7/08* (2006.01)

(52) U.S. Cl.
USPC ..... 343/788; 343/787; 343/866

(58) Field of Classification Search
USPC ..... 343/741, 742, 787, 788, 866, 867
See application file for complete search history.

(56) References Cited

U.S. PATENT DOCUMENTS 2,740,114 A * 3/1956 Adams ..... 343/788
6,163,305 A * 12/2000 Murakami et al. ..... 343/788
7,081,864 B2 * 7/2006 Okamura et al. ..... 343/788
7,167,140 B2 * 1/2007 Kato et al. ..... 343/788
7,372,421 B2 * 5/2008 Ohara ..... 343/788
7,522,117 B2 * 4/2009 Takahashi ..... 343/787
7,699,231 B2 4/2010 Yamaguchi
7,969,372 B2 6/2011 Miyashita
8,077,106 B2 * 12/2011 Sato ..... 343/788
8,242,963 B2 8/2012 Miyashita
2009/0179812 A1 7/2009 Nakamura
2009/0315792 A1 12/2009 Miyashita
2010/0053014 A1 3/2010 Yosui
2011/0195661 A1 8/2011 Miyashita
2012/0025939 A1 2/2012 Yamaguchi
2012/0098711 A1 4/2012 Yosui
2012/0098724 A1 4/2012 Yosui

FOREIGN PATENT DOCUMENTS

EP 2 120 290 11/2009
EP 2 387 109 11/2011
GB 2469209 10/2010
JP 2001-010264 1/2001

(Continued)

OTHER PUBLICATIONS

Partial European Search Report dated Mar. 13, 2013.

*Primary Examiner* — Tho G Phan
(74) *Attorney, Agent, or Firm* — Seed IP Law Group PLLC

(57) ABSTRACT

The claimed invention discloses an antenna including: a magnetic core (11); a coil winding section (14*a*, 14*b*) in which a conductive wiring line is wound around the magnetic core; and an adjustment section (13) connected to one end of the coil winding section. The adjustment section (13) is disposed at an end part of the magnetic core (11) and includes a plurality of adjustable conductive wiring lines (13*b*-13*d*) formed by dividing a conductive wiring line connected to one end of the coil winding section (14*a*, 14*b*) into multiple conductive wiring lines in a direction intersecting with a winding axis direction of the coil winding section (14*a*, 14*b*).

15 Claims, 25 Drawing Sheets

(56) References Cited

FOREIGN PATENT DOCUMENTS

| | | |
|---|---|---|
| JP | 2009-124595 | 6/2009 |
| JP | 4286977 | 7/2009 |
| JP | 4325621 | 9/2009 |
| JP | 2010-245776 | 10/2010 |
| JP | 2012-39672 | 2/2012 |
| JP | 4883208 | 2/2012 |
| WO | 2006/110105 | 10/2006 |
| WO | 2008/016138 | 2/2008 |
| WO | 2011/036963 | 3/2011 |

* cited by examiner (a)

(b)

(a)

(b)

ANTENNA, ANTENNA APPARATUS, AND COMMUNICATION APPARATUS

CROSS REFERENCE TO RELATED APPLICATIONS

This application is entitled to and claims the benefit of Japanese Patent Applications No. 2011-261414, filed on Nov. 30, 2011, No. 2011-288451, filed on Dec. 28, 2011 and No. 2012-177027, filed on Aug. 9, 2012, the disclosure of which including the specification, drawings and abstract is incorporated herein by reference in its entirety.

TECHNICAL FIELD

The claimed invention relates to an antenna, an antenna apparatus, and a communication apparatus that perform communication with radio communication media such as an IC card/tag, including an RF-ID card/tag and an NFC card/tag and/or the like.

BACKGROUND ART

Conventionally, when adjusting antenna characteristics in a non-contact type IC card/tag such as an RF-ID or NFC card/tag, a capacitor pattern and a resistance pattern for adjustment are formed on an inner side of a planar loop-shaped antenna coil formed in a spiral shape on a substrate, and adjustment of the resonance frequency of the antenna or adjustment of a Q factor is performed by cutting or etching the aforementioned patterns (for example, see Japanese Patent No. 4286977). However, since it is difficult to decrease the size of an antenna according to the technology described in the aforementioned Japanese Patent No. 4286977, a small-sized antenna has been proposed that has a shape in which an antenna coil is wound around a core formed of ferrite and/or the like (for example, see Japanese Patent No. 4883208).

SUMMARY OF INVENTION

Technical Problem

However, according to the technology described in the aforementioned Japanese Patent No. 4883208 it is difficult to adjust inductance which is a contributory factor in determining resonance frequency, and miniaturization may be compromised by insuring a space which provides an inductance adjustment mechanism. That is, with regard to an antenna in which an antenna coil is wound in a planar loop shape, a space can be insured in which an inductance adjustment mechanism is provided on the inner side of the antenna coil. However, an antenna in which the coil is wound around a core lacks space. Consequently, it is difficult to limit variations in a resonance frequency for communication of an antenna by limiting variations in the inductance of the antenna unit alone.

An object of the claimed invention is to provide an antenna, an antenna apparatus and a communication apparatus that can adjust inductance by a simple method while maintaining a small size, even in the case of an antenna in which a coil is wound around a core.

Solution to Problem

To solve the above described problem, the claimed invention is an antenna that includes: a magnetic core; a coil winding section in which a conductive wiring line is wound around the magnetic core; and an adjustment section connected to one end of the coil winding section. The adjustment section is disposed at an end part of the magnetic core, and includes a plurality of adjustable conductive wiring lines formed by dividing a conductive wiring line that is connected to one end of the coil winding section into a plurality of conductive wiring lines in a direction that intersects with a direction of the winding axis of the coil winding section. The plurality of adjustable conductive wiring lines are connected with each other at both ends of the adjustable conductive wiring lines.

Advantageous Effects of Invention

According to the claimed invention, an inductance can be adjusted by a simple method while maintaining a small size, even in the case of an antenna in which a coil is wound around a core.

DESCRIPTION OF EMBODIMENTS

Embodiment 1

Figure 1:
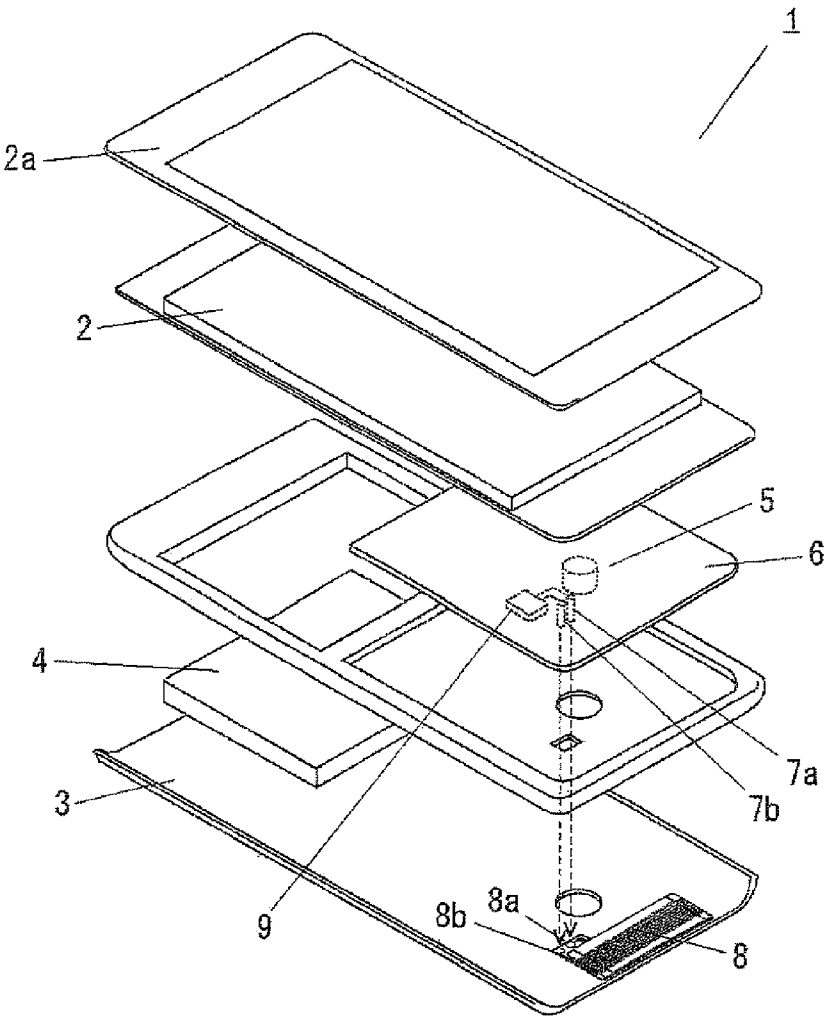
FIG. 1 is an exploded perspective view of a portable terminal in which an antenna according to Embodiment 1 of the claimed invention is mounted.

FIG. 1 is an exploded perspective view of a portable terminal in which an antenna according to Embodiment 1 of the claimed invention is mounted. Portable terminal 1 includes display panel 2, back cover 3, battery 4 that can fit between display panel 2 and back cover 3, camera 5, electronic circuit board 6 and/or the like. Although, as illustrated in FIG. 1, display panel 2 may be of a touch panel type without any operation buttons, but there are cases where display panel 2 is not of a touch panel type. Thus, display panel 2 may also be provided with separate operation buttons. Display panel 2 is a liquid crystal panel and includes panel cover 2*a*. Antenna 8 that is an embodiment of the claimed invention is installed on back cover 3 by attaching antenna 8 with an adhesive tape or by fixing antenna 8 to cover 3 with screws or the like. In this connection, in the present embodiment, antenna 8 is arranged adjacent to an upper peripheral portion (peripheral portion close to camera 5 that is away from battery 4) of back cover 3, and is arranged between camera 5 and the upper peripheral portion of back cover 3. Although antenna 8 may be arranged so as to overlap with battery 4, portable terminal 1 can be made thinner overall by arranging antenna 8 so as to overlap with electronic circuit board 6 that is thinner than battery 4. In the present embodiment, while antenna 8 is disposed at a flat portion of back cover 3, it is also possible to dispose antenna 8 along a curved face of back cover 3.

External connection terminals 8*a* and 8*b* for making a connection with electronic circuit board 6 to form an antenna apparatus are provided on a surface facing electronic circuit board 6 of antenna 8. Electronic circuit board 6 may be connected to antenna 8 via pins, a connector, or soldering of conductive wiring lines or the like. In the present embodiment, antenna input/output pins 7*a* and 7*b* are provided on electronic circuit board 6. It is assumed that, as is generally known, antenna input/output pins 7*a* and 7*b* are connected to antenna control section 9 on electronic circuit board 6 on which a matching circuit and a control IC and/or the like are disposed. The antenna apparatus is formed by connecting antenna input/output pins 7*a* and 7*b* with a coil section that takes external connection terminals 8*a* and 8*b* provided in antenna 8 as both end parts thereof. Note that, in addition to an IC for an RF-ID and a matching circuit, components such as a multi-frequency antenna, a speaker, and an RE module are disposed in a space that can be formed between back cover 3 and display panel 2.

Figure 2:
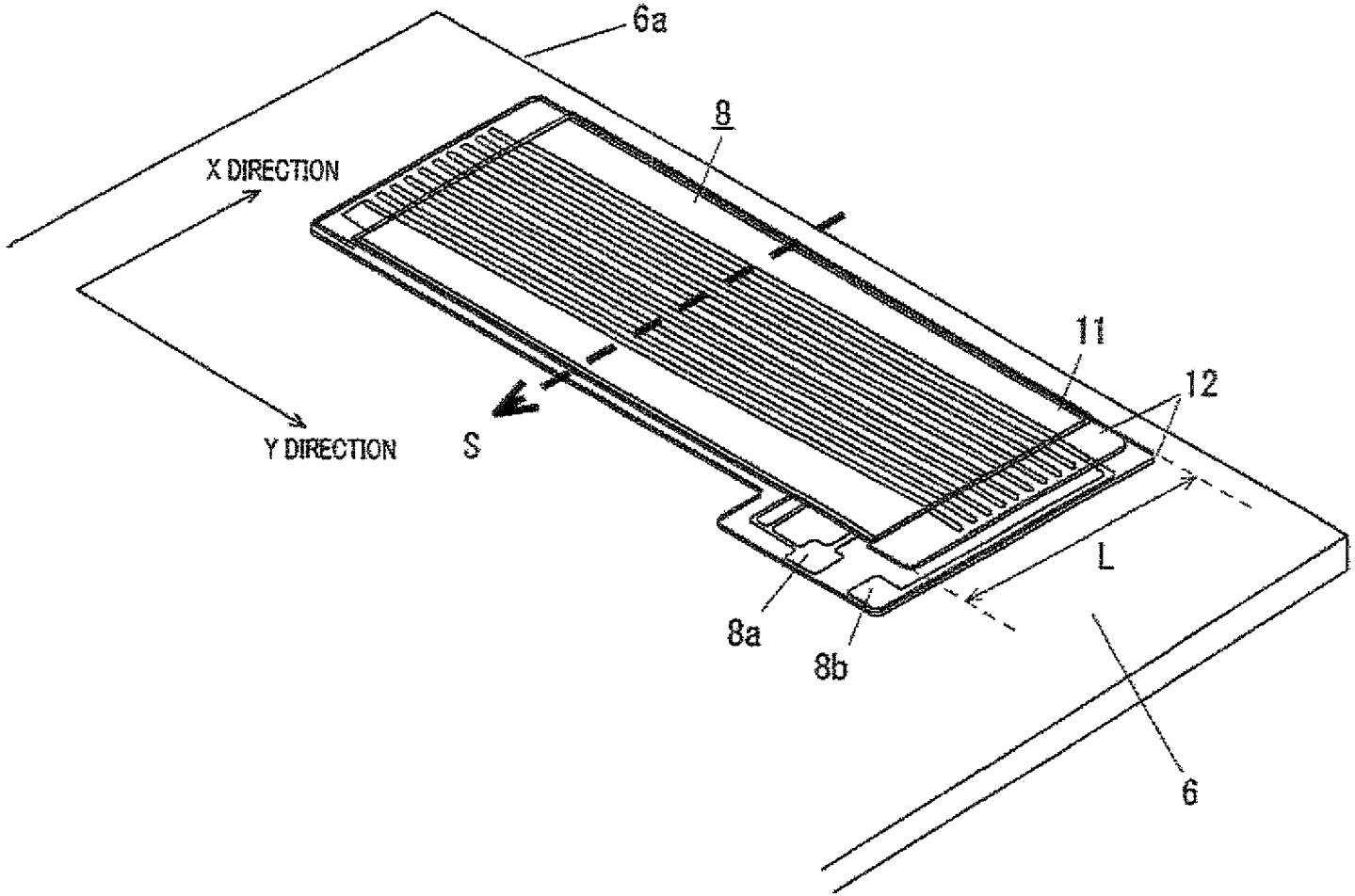
FIG. 2 is a perspective view of the antenna according to Embodiment 1 of the claimed invention.
Figure 3:
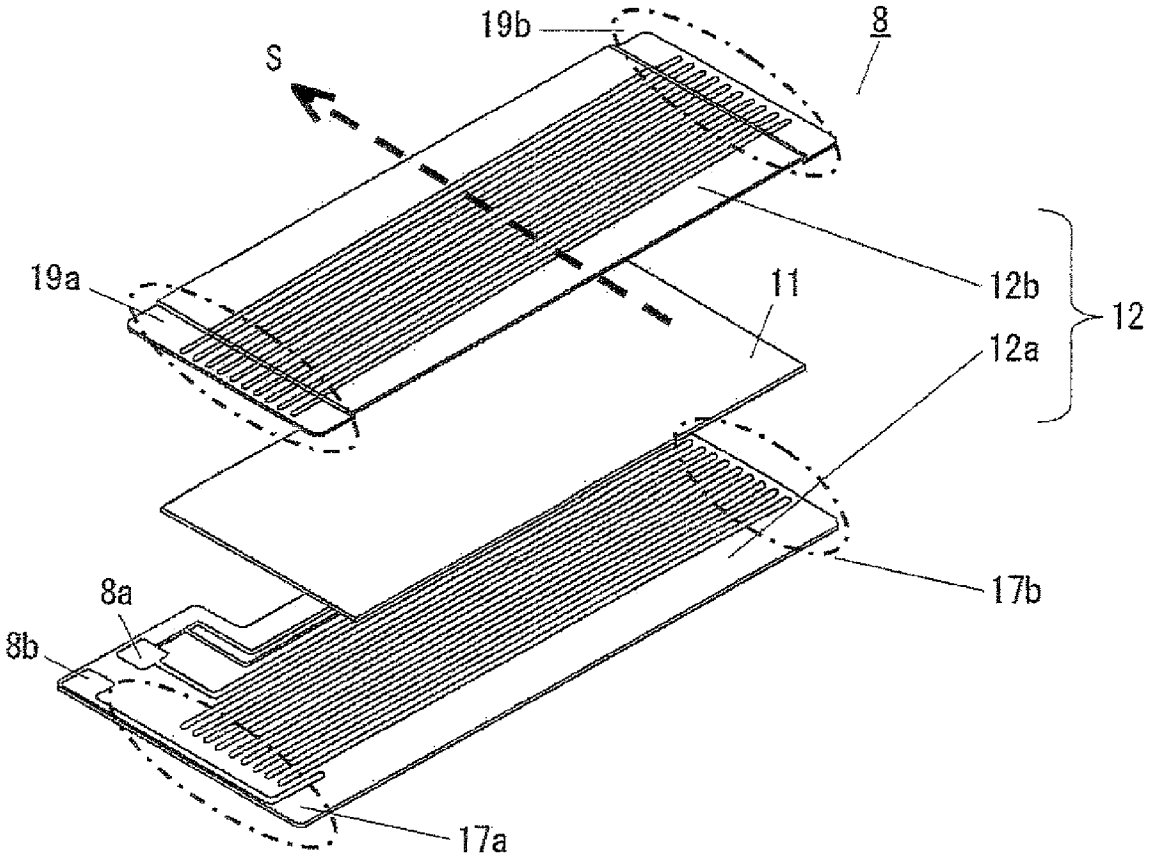
FIG. 3 is an exploded perspective view of the antenna according to Embodiment 1 of the claimed invention.
Figure 4:
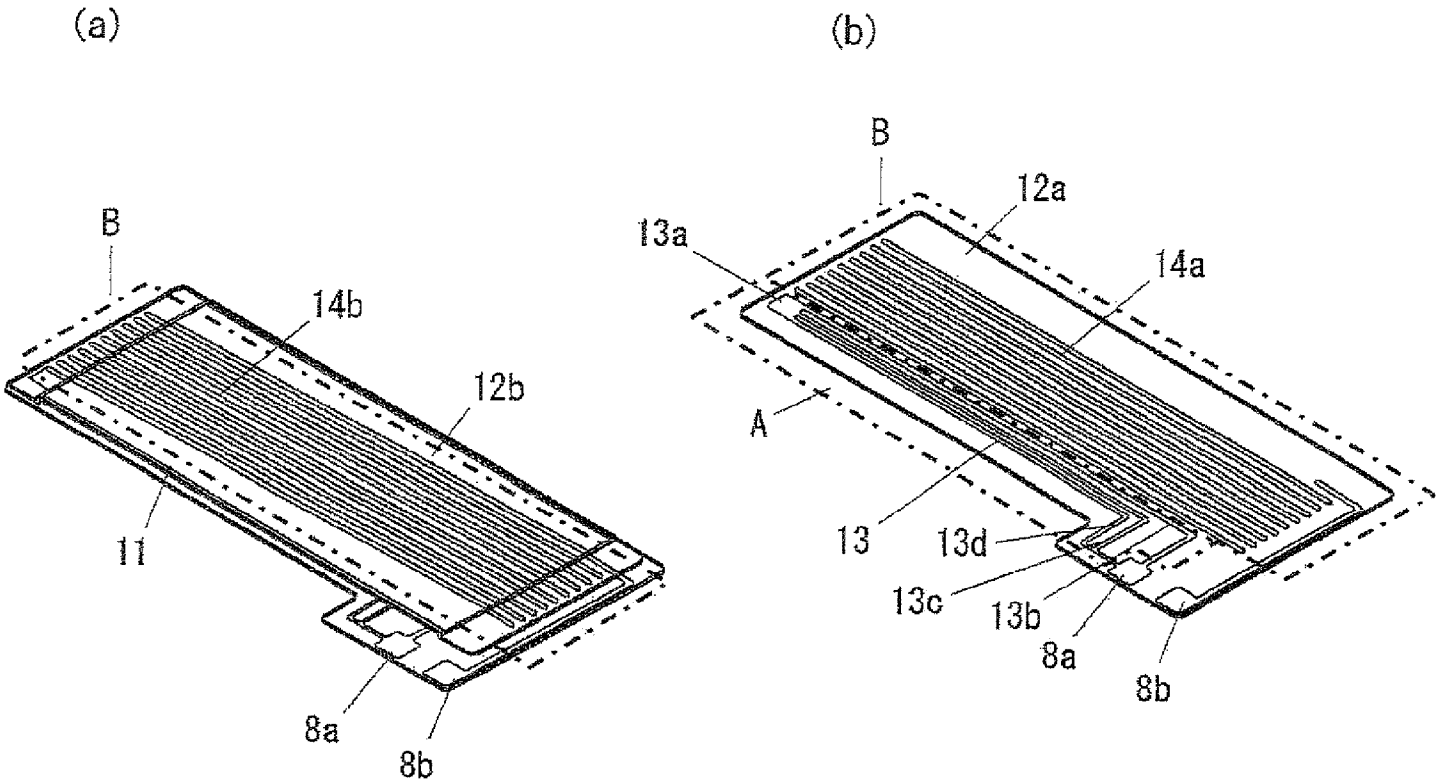
FIG. 4 is a diagram illustrating a conductor arrangement section and an adjustment pattern of the antenna according to Embodiment 1 of the claimed invention.

FIG. 2 is a perspective view of the antenna according to Embodiment 1 of the claimed invention. FIG. 3 is an exploded perspective view of the antenna according to Embodiment 1 of the claimed invention. Furthermore, FIG. 4 is a diagram illustrating a conductor arrangement section and an adjustment pattern of the antenna according to Embodiment 1 of the claimed invention.

As illustrated in FIG. 2, antenna 8 of the present embodiment includes core 11 formed by a magnetic body such as ferrite, amorphous alloy, silicon steel, perm alloy, or soft magnetic material, and flexible substrate 12 that is arranged so as to envelop the circumference thereof and on which a coil pattern (conductive wiring line) and/or the like are formed on a support medium mainly formed of resin. In the present embodiment, core 11 is made of ferrite, and according to the present embodiment the size of core 11 is 13.7×33.5×0.3 mm, and there is a possibility of the size being approximately 13.4 to 14 mm×33.2 to 33.8 mm×0.27 mm to 0.33 mm due to variations in dimensions after the firing. Core 11 can be said to have a parallelepiped shape, and particularly a rectangular parallelepiped plate shape. As used herein, the term "coil pattern" refers to a component that generates the lines of magnetic force for performing communication with radio communication media such as an IC card or IC tag (not illustrated). Although the specific shape of the coil pattern is not illustrated in FIG. 2 and FIG. 3, a coil pattern having a coil axis indicated by straight line S with an arrow is formed. Normally, the coil pattern and an adjustment pattern that is described hereinafter are formed, for example, by copper foil that is formed between two resin layers, namely, a polyimide film and a cover lay or resist, of flexible substrate 12. The term "coil axis S" refers to an axis that the coil pattern is wound around in a manner such that coil axis S is at approximately the center of the coil pattern, and that is substantially perpendicular to the coil pattern of flexible substrate 12. A conductive pattern formed on flexible substrate 12 that includes the coil pattern is described in detail hereinafter with reference to FIG. 4. Note that, a conductive wiring line is not limited to a component formed by a conductive pattern, and may be of any form, such as a form obtained by winding a metal wiring line and/or the like around core 11 or forming a conductive film on core 11.

Core 11 extends two-dimensionally in the X direction and Y direction as illustrated in FIG. 2, and is a thin shape in a thickness direction that is perpendicular to the X direction and the Y direction (same direction as coil axis S). The coil pattern is wound in the X direction. It is advantageous for core 11 to be longest in the X direction that is parallel to the coil pattern, and for a thickness thereof in the thickness direction to be less than an X direction width and a Y direction width.

In practice, as illustrated in FIG. 3, flexible substrate 12 has a shape that is divided into two parts to hold core 11 in between. In the present embodiment, for convenience, among the parts of flexible substrate 12 that is divided in two, one of the parts that has external connection terminals 8*a* and 8*b* is referred to as lower-side flexible substrate 12*a* and the other is referred to as upper-side flexible substrate 12*b*. Although described in further detail hereinafter, lower-side flexible substrate 12*a* and upper-side flexible substrate 12*b* are joined by soldering. In the present embodiment, lower-side flexible substrate 12*a* and upper-side flexible substrate 12*b* are joined at two edges of flexible substrate 12 that are approximately parallel with coil axis S. The terms "lower-side" and "upper-side" are used herein to facilitate understanding in FIG. 3, so that the upper and lower sides may be reversed upside down at a time of mounting in a device as antenna 8.

In the present embodiment, the width of upper-side flexible substrate 12*b* in the direction of coil axis S is set so that core 11 does not protrude therefrom. This is because, particularly in a case in which core 11 is made of ferrite that is easily broken, broken pieces or residue of core 11 are prevented from scattering inside a communication apparatus in which antenna 8 is incorporated (for example, portable terminal in FIG. 1) and adversely affecting the communication apparatus.

In the present embodiment, double-faced adhesive tapes are used as adhesive layers for fixing core 11 between lower-side flexible substrate 12*a* and upper-side flexible substrate 12*b*. More specifically, a double-faced adhesive tape is disposed between core 11 and lower-side flexible substrate 12*a* and between core 11 and upper-side flexible substrate 12*b*.

In addition, although not illustrated in the drawings, slits with a pitch of, for example, 2 to 5 mm are formed in advance in at least one of the surfaces of core 11 that respectively face lower-side flexible substrate 12*a* and upper-side flexible substrate 12*b* according to the present embodiment. Since core 11 is divided into small pieces utilizing the slits, core 11 is flexible. Furthermore, as mentioned above, the double-faced adhesive tapes are attached to the surfaces of core 11 according to the present embodiment that respectively face lower-side flexible substrate 12*a* and upper-side flexible substrate 12*b*. Furthermore, lower-side flexible substrate 12*a* and upper-side flexible substrate 12*b* are originally flexible.

Hence, even if a location at which antenna 8 is attached to back cover 3 of portable terminal 1 illustrated in FIG. 1 has a curved face, antenna 8 may be adhesively disposed along the curved face. Therefore, in some cases, at least that part of core 11 is divided by the aforementioned slits so that core 11 is in a state of being formed by a plurality of small pieces. If core 11 is not attached to anything, core 11 comes apart at that point in time. The double-faced adhesive tape attached to the surfaces of core 11 facing lower-side flexible substrate 12*a* and upper-side flexible substrate 12*b* prevents core 11 from coming apart. In addition, core 11 optionally includes a protective tape. Therefore, according to the above described configuration, with respect to FIG. 2 and FIG. 3, it is possible to prevent a situation where some of the small pieces of core 11 that is divided by the aforementioned slits drop off and the dropped off small pieces or residues of the small pieces scatter inside a communication apparatus in which antenna 8 is incorporated (for example, portable terminal 1 in FIG. 1). As a result, no adverse effect is given to the communication apparatus.

With regard to a method for fixing core 11 to flexible substrate 12, it is not necessarily the case that double-faced adhesive tapes must be attached to both sides of core 11 as described in the present embodiment. For example, the double-faced adhesive tape may be attached to only one side. A method may also be considered that, instead of attaching a double-faced adhesive tape between core 11 and each flexible substrate, adheres lower-side flexible substrate 12*a* and upper-side flexible substrate 12*b* at two edges of flexible substrate 12 which are not joined by soldering and are substantially orthogonal to coil axis S. At this time, it is necessary to extend lower-side flexible substrate 12*a* and upper-side flexible substrate 12*b* further outward in the direction of coil axis S than the outer edge of core 11. Moreover, with respect to adhesion of this portion, other than the adhesion using a double-faced adhesive tape in as described above, a method of directly applying an adhesive to this portion is also possible.

Note that, in the present embodiment a double-faced adhesive tape is also attached to a surface that does not face core 11 of lower-side flexible substrate 12*a*. In this case the double-faced adhesive tape is for attaching and fixing antenna 8 to back cover 3 of portable terminal 1 as illustrated in the above described FIG. 1.

The present embodiment will be described referred to FIG. 3 again. As described above, in lower-side flexible substrate 12*a* and upper-side flexible substrate 12*b* constituting flexible substrate 12, conductive wiring lines are joined together by soldering at two edges of flexible substrate 12 that are approximately parallel with coil axis S. In FIG. 3, lower-side flexible substrate 12*a* includes adjustment pattern 13 as illustrated in FIG. 4 that is described hereinafter, and that includes pattern exposing sections 17*a* and 17*b* for enabling joining by soldering. Similarly, upper-side flexible substrate 12*b* is also provided with pattern exposing sections 19*a* and 19*b* for enabling joining by soldering of lower-side flexible substrate 12*a* and upper-side flexible substrate 12*b*. The two ends of divided patterns formed by dividing the coil pattern into a plurality of patterns are exposed as illustrated in FIG. 4 that is described hereinafter.

According to the present embodiment, in a state before flexible substrate 12 is assembled, a solder plating process is performed in advance on the copper foil at the two ends of the divided patterns that are exposed by pattern exposing sections 19*a* and 19*b* of upper-side flexible substrate 12*b*. Furthermore, a gold plating process is performed in advance on the copper foil at the two ends of the divided patterns exposed by pattern exposing sections 17*a* and 17*b* and the copper foil of external connection terminals 8*a* and 8*b* provided in lower-side flexible substrate 12*a*. The gold plating process is essential for ensuring reliability and preventing corrosion when external connection terminals 8*a* and 8*b* are brought into contact with antenna input/output pins 7*a* and 7*b* provided on electronic circuit board 6. Even in a state in which a gold plating process or a solder plating process has been performed in this manner, the copper foil at the relevant portions is described as being "exposed" in the present embodiment. A single coil pattern is formed as a result of performing the above processes. More specifically, a coil pattern and another conductive pattern formed on flexible substrate 12 are formed as illustrated in FIG. 4.

FIG. 4(*a*) is a perspective view of the antenna according to an embodiment of the claimed invention. FIG. 4(*b*) is a perspective view of the lower-side flexible substrate of the antenna according to an embodiment of the claimed invention, in addition to winding patterns 14*a*, lower-side flexible substrate 12*a* has external connection terminals 8*a* and 8*b* and adjustment pattern 13.

Antenna 8 includes core 11 that is a magnetic body, winding patterns 14*a* and 14*b* as coil winding sections in which a conductive wiring line is wound around core 11, and adjustment pattern 13 as an adjustment section connected to one end of winding patterns 14*a* and 14*b*. Since adjustment pattern 13 is formed at an end part of core 11, for example, external connection terminal 8*a* is connected to adjustment pattern 13 and is not inserted among winding patterns 14*a*, and external connection terminal 8*b* is connected to winding patterns 14*a* and 14*b*. Adjustment pattern 13 includes a plurality of adjustable conductive wiring lines 13*b* to 13*d* in a longitudinal direction of adjustment pattern 13. The plurality of adjustable conductive wiring lines 13*b* to 13*d* are separated from each other in the longitudinal direction but connected to each other at both ends of adjustable conductive wiring lines 13*b* to 13*d* and are connected to adjustment pattern end 13*a* and external connection terminal 8*a* as illustrated in FIG. 4(*b*).

That is, a plurality of winding patterns 14*a* that are part of a coil pattern for performing communication with radio communication media such as an IC card or an IC tag and/or the like are formed on lower-side flexible substrate 12*a* so as to be parallel with each other and to intersect with coil axis S. Furthermore, on upper-side flexible substrate 12*b*, a plurality of winding patterns 14*b* that are part of a coil pattern are formed so as to be parallel with each other and to intersect with coil axis S. The two ends of the plurality of winding patterns 14*a* and 14*b* are in a state in which copper foil is "exposed" by the respective pattern exposing sections 17*a* and 17*b* and pattern exposing sections 19*a* and 19*b*. In FIGS. 4(*a*) and 4(*b*), winding patterns 14*a* and 14*b* are formed in region B. The pattern formed in region A of lower-side flexible substrate 12*a* is adjustment pattern 13 that is part of the coil pattern. In the present embodiment, adjustment pattern 13 is formed on only lower-side flexible substrate 12*a* and is not formed on upper-side flexible substrate 12*b*. In this case, lower-side flexible substrate 12*a* is disposed on a side that is away from electronic circuit board 6 (metal body) inside portable terminal 1, and upper-side flexible substrate 12*b* is disposed on a side that faces electronic circuit board 6 (metal body) inside portable terminal 1. However, adjustment pattern 13 may be formed only on upper-side flexible substrate 12*b*, or may be formed on both lower-side flexible substrate 12*a* and upper-side flexible substrate 12*b*. Adjustment pattern 13 is formed by dividing one of the conductive wiring lines of winding patterns 14*a* of lower-side flexible substrate 12*a* into three parallel conductive wiring lines. Accordingly, the pattern of three divided conductive wiring lines is connected with adjustment pattern end 13*a* and external connection terminal 8*a*.

Figure 5:
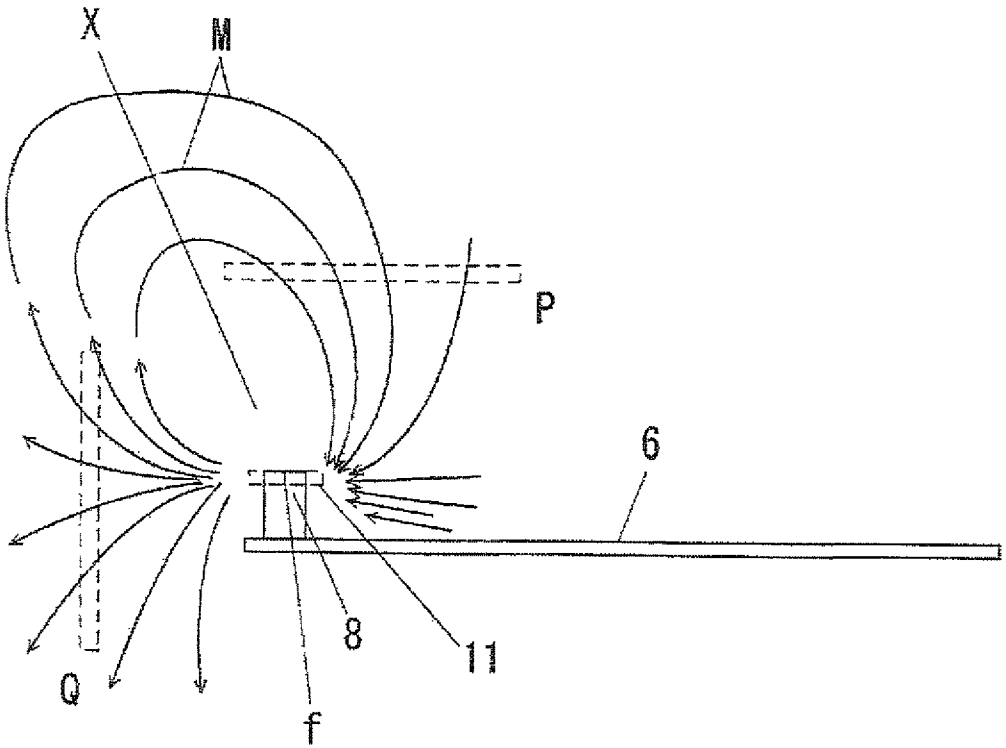
FIG. 5 is a conceptual diagram illustrating an antenna apparatus formed by an electronic circuit board and an antenna mounted in the portable terminal illustrated in FIG. 1, and the lines of magnetic force generated from the antenna apparatus.
Figure 6:
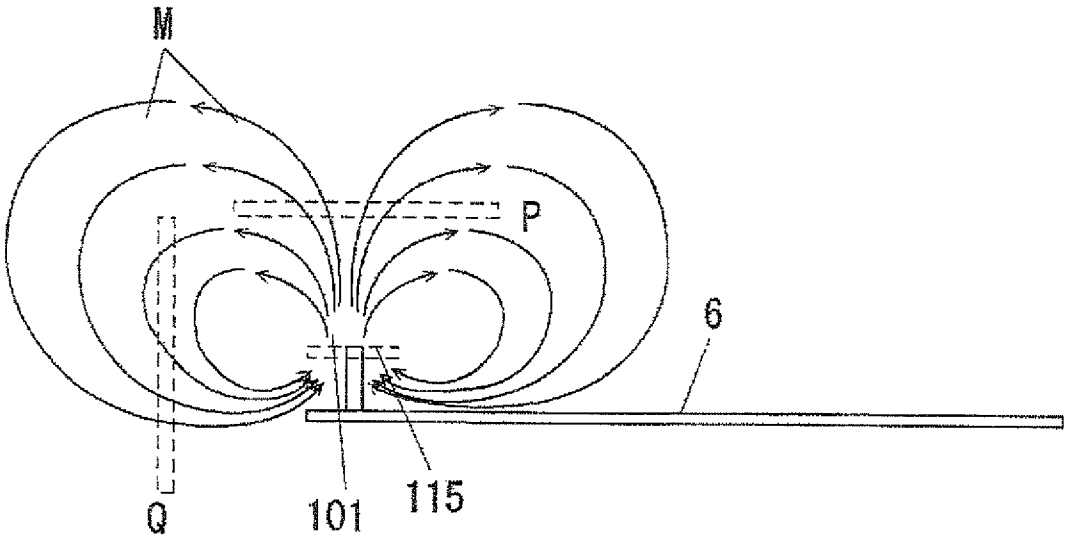
FIG. 6 is a conceptual diagram illustrating an antenna apparatus according to a related art example, and the lines of magnetic force generated from the antenna apparatus.

FIG. 5 is a conceptual diagram illustrating an antenna apparatus formed by electronic circuit board 6 and antenna 8 mounted in portable terminal 1 illustrated in FIG. 1, and the lines of magnetic force generated from the antenna apparatus. FIG. 6 is a conceptual diagram illustrating an antenna apparatus according to a related art example and the lines of magnetic force generated from the antenna apparatus, which is a diagram used for comparison with the antenna apparatus of the present embodiment illustrated in FIG. 5. Although not illustrated in the drawings, antenna 101 illustrated in FIG. 6 includes an antenna coil formed in a spiral shape on a surface on an opposite side to a surface facing electronic circuit board 6, as described in the aforementioned Japanese Patent No. 4286977.

As illustrated in FIG. 5, the antenna apparatus of the present embodiment includes antenna 8 that has a coil section, and electronic circuit board 6 that is disposed adjacent to antenna 8. As is generally known, a wiring pattern that connects together terminals of each circuit component mounted on electronic circuit board 6 is provided on a surface or inside electronic circuit board 6. As a result of miniaturization achieved by modern circuit integration, in most cases electronic circuit board 6 has a plurality of wiring layers. Accordingly, in many cases power supply line for supplying power to each circuit component and GND (ground) line are provided as a separate wiring layer to the aforementioned wiring pattern. Naturally, these wiring patterns, power supply wiring line and GND wiring line are conductors made of copper and/or the like. That is, electronic circuit board 6 can be regarded as a metal body. When power supply wiring line or GND wiring line are provided as a separate wiring layer as mentioned above, since these wiring lines are formed over almost the entire area of the allocated wiring layer, electronic circuit board 6 becomes a metal body of particularly good quality. Furthermore, as long as a metal body achieves the object of the present application, any kind of metal may be adopted as the metal body, such as a metal body forming at least part of back cover 3, a metal film formed on back cover 3, a metal body of part of the panel in a case where display panel 2 is liquid crystal, a shield plate, a metal layer of battery 4, a metal component of camera 5, or a component including metal mounted on electronic circuit board 6.

Thus, in the antenna apparatus having antenna 8 and electronic circuit board 6 that can be regarded as practically a metal body, an opening section of the coil section of antenna 8 is perpendicular to the face of electronic circuit board 6, and antenna 8 is disposed at an end part of electronic circuit board 6. Note that the term "end part of electronic circuit board 6" includes both a case where an end part of antenna 8 protrudes beyond an outermost end part of electronic circuit board 6 and a case where the end part of antenna 8 is positioned further on the inner side than the outermost end part of electronic circuit board 6.

In contrast, since the antenna apparatus of prior art illustrated in FIG. 6 includes an antenna coil formed in a spiral shape on a surface on an opposite side to a surface facing electronic circuit board 6, opening section 115 of antenna 101 is parallel to electronic circuit board 6. When antenna 101 receives a signal, the current flows in region P at a certain time, the lines of magnetic force generated from antenna 101 are all in a direction away from antenna 101, and the lines of magnetic force M pass in only one direction. As a result, a current flows through, for example, a non-contact type IC card positioned in region P, and the portable terminal in which the antenna apparatus of prior art, which includes electronic circuit board 6 and antenna 101, and the non-contact type IC card can communicate with each other. However, in region Q, the lines of magnetic force M extend in two opposite directions, namely a direction away from antenna 101 and a direction towards antenna 101. Therefore, if a non-contact type IC card is positioned in region Q, that is, substantially right next to the antenna and substantially perpendicular to electronic circuit board 6, the lines of magnetic force M in both directions act on the non-contact type IC card and cancel each other out. As a result, no current flows through the non-contact type IC card, and no communication is performed between the portable terminal in which the antenna apparatus of prior art that includes electronic circuit board 6 and antenna 101, and the non-contact type IC card.

However, according to the antenna apparatus of the present embodiment illustrated in FIG. 5, the opening section of the coil section of antenna 8 is substantially perpendicular to electronic circuit board 6, and antenna 8 is arranged so that the longitudinal direction of the coil section of antenna 8 is substantially parallel to an endmost part of electronic circuit board 6. The coil axis of antenna 8 is substantially parallel to electronic circuit board 6. Therefore, even when, for example, a non-contact type IC card is positioned in not only region P but also in region Q, favorable communication can be performed. Note that, the terms "substantially parallel" and "substantially perpendicular" mean that it is not necessary to be strictly parallel or perpendicular, and the effect of the invention of the present application can be favorably obtained without any problem if the angle formed by the directions is within a tolerance of approximately plus/minus 15 degrees, and the effect of the invention of the present application can be obtained if the angle formed by the directions is within a tolerance of at least approximately plus/minus 30 degrees.

That is, since the opening section of antenna 8 is perpendicular to electronic circuit board 6, when antenna 8 receives a signal, and a current flows, in region Q at a certain time, the lines of magnetic force M generated from antenna 8 are all in a direction away from antenna 8, and the lines of magnetic force M pass in only one direction. As a result, a current flows through, for example, a non-contact type IC card positioned in region Q, and the portable terminal in which the antenna apparatus of the present embodiment that includes electronic circuit board 6 and antenna 8 is mounted and the non-contact type IC card can communicate with each other.

In addition, in region P also, when antenna 8 receives a signal, and a current flows, in region P at a certain time, the direction of the lines of magnetic force M is either one of a direction away from antenna 8 and a direction towards antenna 8. This is because the lines of magnetic force M generated from antenna 8 attenuate in the vicinity of electronic circuit board 6, and therefore axis X of the lines of magnetic force M is not perpendicular to electronic circuit board 6 and is inclined relative thereto. As a result, a current flows through, for example, a non-contact type IC card positioned in region P, and the portable terminal on which the antenna apparatus of the present embodiment that includes electronic circuit board 6 and antenna 8 is mounted and the non-contact type IC card can communicate with each other.

The lines of magnetic force M illustrated in FIG. 5 includes axis X that joins together the boundaries of the lines of magnetic force in a direction away from antenna 8 and the lines of magnetic force in a direction towards antenna 8. When a non-contact type IC card, for example, is placed in the vicinity of axis X of the lines of magnetic force M, the lines of magnetic force in both the direction away from antenna 8 and the direction towards antenna 8 act on the non-contact type IC card and cancel each other out in the same manner as in region Q in FIG. 6 according to the prior art technology. As a result, no current flows through the non-contact type IC card, and communication is not conducted between the portable terminal in which the antenna apparatus of the present embodiment is mounted and the non-contact type IC card.

Next, the reason that axis X of the lines of magnetic force M incline with respect to electronic circuit board 6 is described. An eddy current that is induced on a surface of electronic circuit board 6 that faces antenna 8 by the line of magnetic force generated by antenna 8 produces the lines of magnetic force in a perpendicular direction to the surface of electronic circuit board 6 that faces antenna 8. Therefore, the lines of magnetic force M generated by antenna 8 and the lines of magnetic force generated from the eddy current induced on the surface of electronic circuit board 6 that faces antenna 8 are combined, and the lines of magnetic force M generated from antenna 8 change to a perpendicular direction in the vicinity of electronic circuit board 6. As a result, axis X of the lines of magnetic force M incline to the side in a direction away from electronic circuit board 6. That is, with respect to the axis direction of antenna 8, because electronic circuit board 6 is disposed on one side of antenna 8 and electronic circuit board 6 is not disposed on the other side thereof, axis X of the lines of magnetic force M can be caused to incline as a result of the magnetic flux being weakened by the eddy current on only one side.

In addition, since antenna 8 is disposed at an end part of electronic circuit board 6, the lines of magnetic force M on electronic circuit board 6 side (the right side in FIG. 5) of antenna 8 attenuate and the lines of magnetic force M on the side away from electronic circuit board 6 (the left side in FIG. 5) of antenna 8 are strengthened relatively. As a result, axis X of the lines of magnetic force M incline with respect to electronic circuit board 6. According to the configuration of the present embodiment, angle $\alpha$ of axis X of the lines of magnetic force M is approximately 40° to 85° relative to electronic circuit board 6 as a result of inclined axis X. If antenna B is not disposed at an end part of electronic circuit board 6, the lines of magnetic force in a direction perpendicular to the surface of electronic circuit board 6 produced by an eddy current on the surface of electronic circuit board 6 decreases, and axis X of the lines of magnetic force M remains substantially perpendicular to electronic circuit board 6. In that case, even though communication may be possible in region Q (diagonal direction and lateral direction), it is difficult to perform communication in region P (directly above).

The end part of antenna 8 may be aligned with an end part of electronic circuit board 6, or the end part of antenna 8 may protrude beyond an end part of electronic circuit board 6. Furthermore, the end part of antenna 8 may be disposed at a position that is further to the inner side than an end part of electronic circuit board 6.

Thus, a current flowing through electronic circuit board 6 can be utilized to the maximum by positioning antenna 8 at an end part of electronic circuit hoard 6. Furthermore, if angle $\alpha$ is approximately 85°, the minimum effect of the claimed invention is obtained, and angle $\alpha$ is preferably 80° or less.

Although the antenna apparatus and electronic circuit board 6 illustrated in FIG. 5 are arranged with a gap of a certain amount therebetween, such a gap is not secured when the antenna apparatus and electronic circuit board 6 are arranged in a portable terminal or the like in some cases. In such a case, the antenna apparatus and electronic circuit board 6 are arranged in contact with each other, as illustrated in FIG. 7.

Figure 7:
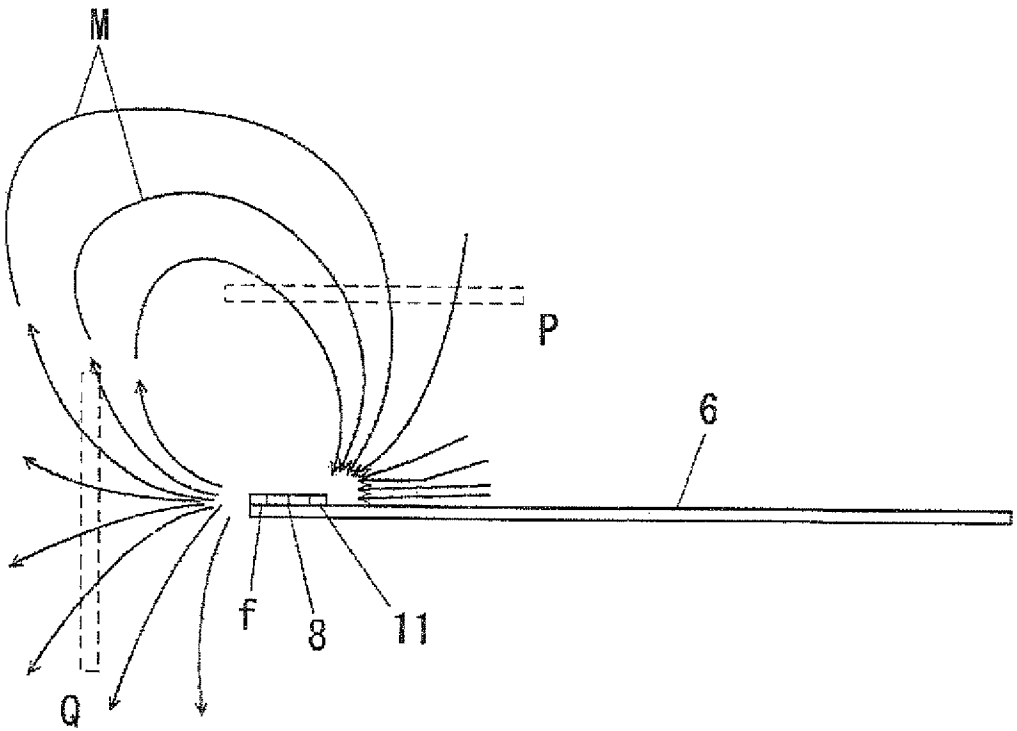
FIG. 7 is a conceptual diagram illustrating another antenna apparatus according to Embodiment 1 of the claimed invention, and the lines of magnetic force generated from the antenna apparatus.

FIG. 7 is a conceptual diagram illustrating an antenna apparatus according to Embodiment 1 of the claimed invention and the lines of magnetic force generated from the antenna apparatus. As illustrated in FIG. 7, even when electronic circuit board 6 and antenna 8 are arranged in contact with each other, the lines of magnetic force incline as a result of the same mechanism as in the antenna apparatus illustrated in FIG. 5.

As described above, regardless of the presence of a gap between electronic circuit board 6 and antenna 8, disposing of one end part of the core on the inner side or outer side of one end part of electronic circuit board 6 within a range of a width in coil axis direction A of the coil section of the core from one end part of electronic circuit board 6, makes it possible to adequately obtain the effect of the claimed invention as long as at least one part of antenna 8 is disposed adjacent to or in contact with one end part of electronic circuit board 6 and a surface including the one end part. It should be noted that it has been confirmed that if the width of the Core is at least 4 to 15 mm, the condition of angle $\alpha \leq 85°$ which allows the effect of the claimed invention to be obtained holds true with respect to the relationship between antenna 8 and electronic circuit board 6 described above. It need scarcely be said that the relationship is based on the assumption that the width of electronic circuit board 6 in coil axis direction A is greater the width of the core in the same direction.

As described above, disposing antenna 8 of an embodiment, of the claimed invention at an end part of electronic circuit board 6 of portable terminal 1 causes the lines of magnetic force to incline, and thereby increases the range in which signals can be transmitted and received. However, the position at which antenna 8 of the embodiment of the claimed invention is to be installed is not limited to this position.

In addition, as illustrated in FIG. 2, when the width of core 11 of antenna 8 in coil axis S direction is referred to as "L," the distance to antenna 8 from edge 6*a* of electronic circuit board 6 that is substantially perpendicular to coil axis S is within a range of −L to +L. As a result, axis X of the lines of magnetic force M can be caused to incline as described above. The term "−L" refers to antenna 8 protruding outward beyond edge 6*a* of electronic circuit board 6, and when antenna 8 is protruding by −L, it indicates that the entire portion of core 11 of antenna 8 is protruding from electronic circuit board 6. The term "+L" has the opposite meaning of "−L," and refers to antenna 8 being positioned on the inner side by a distance corresponding to L from edge 6*a* of electronic circuit board 6. It is advantageous for at least one part of antenna 8 to overlap with electronic circuit board 6, as viewed from above the surface of electronic circuit board 6.

Next, the distance to antenna 8 from edge 6*a* of electronic circuit board 6 that is in a substantially perpendicular relationship with coil axis S is described in detail.

Figure 8:
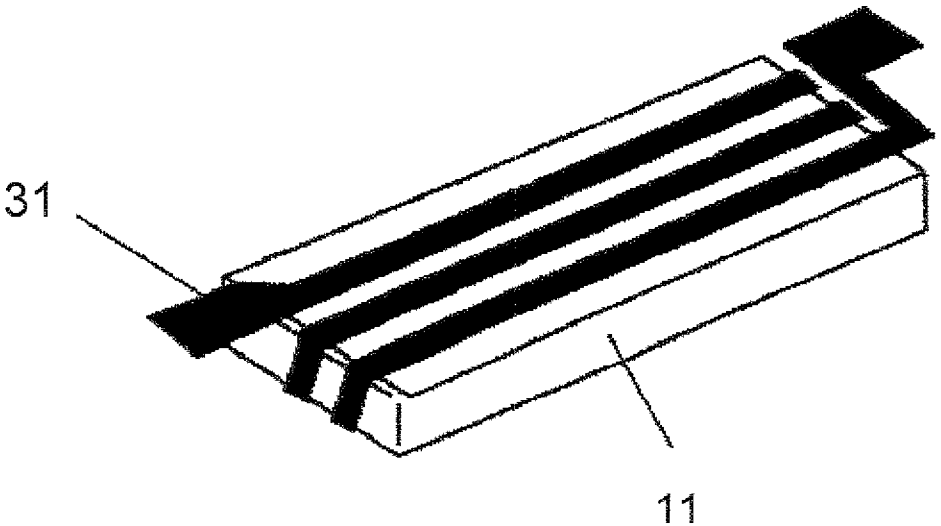
FIG. 8 is a conceptual diagram of an antenna according to Embodiment 1 of the claimed invention.
Figure 9:
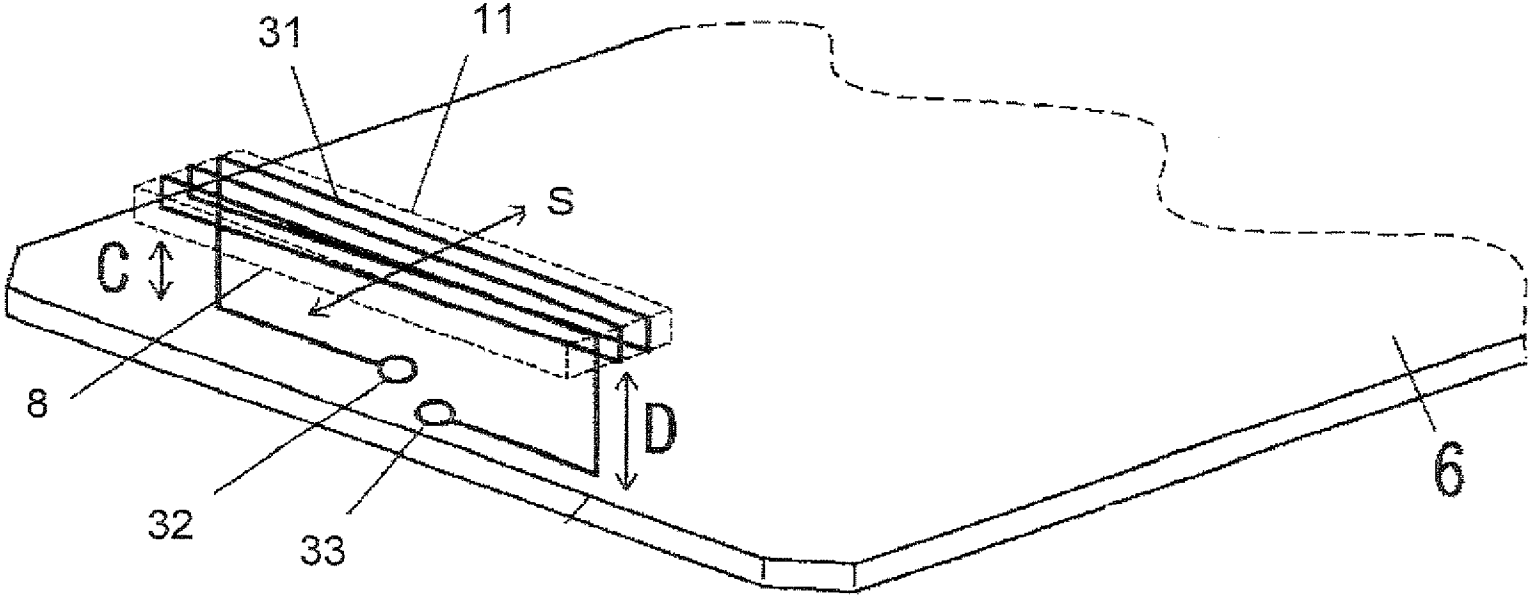
FIG. 9 is a conceptual diagram of an antenna apparatus according to Embodiment 1 of the claimed invention.
Figure 10:
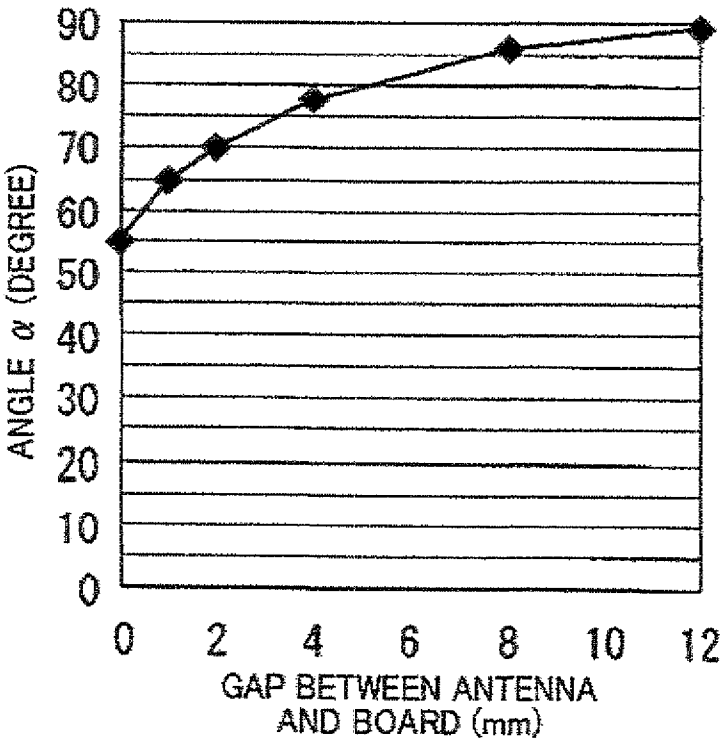
FIG. 10 is a diagram illustrating a relationship between distance D and angle $\alpha$ of axis X of a magnetic field according to Embodiment 1 of the claimed invention.
Figure 11:
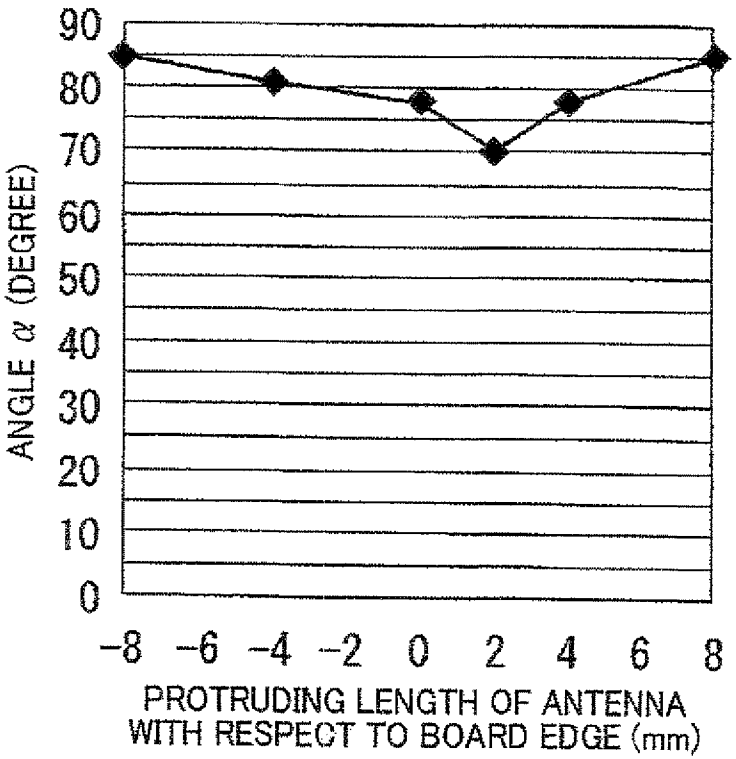
FIG. 11 is a diagram illustrating a relationship between distance d and angle $\alpha$ of axis X of a magnetic field according to Embodiment 1 of the claimed invention.

FIG. 8 is a conceptual diagram of the antenna according to Embodiment 1 of the claimed invention. FIG. 9 is a conceptual diagram of an antenna apparatus according to Embodiment 1 of the claimed invention. FIG. 10 is a diagram illustrating a relationship between distance D and angle α of axis X of a magnetic field according to Embodiment 1 of the claimed invention. FIG. 11 is a diagram illustrating a relationship between distance d and angle α of axis X of a magnetic field according to Embodiment 1 of the claimed invention. In this case, portions corresponding to winding patterns 14*a* and 14*b* in FIGS. 1 to 4 are taken as coil section 31, and adjustment pattern 13 is not provided.

FIG. 8 illustrates a path over which a current flows from antenna input/output terminal 32 (or 33) to the other antenna input/output terminal 33 (or 32). According to the embodiment, adjustment is performed so that, for example, RFID (13.56 MHz) radio waves can be sent and received by the antenna apparatus.

Coil section 31 is inserted to a position that faces antenna input/output terminals 32 and 33. It is thus possible to perform formation in an unrestricted manner when forming the antenna apparatus by linking coil section 31 and antenna input/output terminals 32 and 33. However, the position of coil section 31 is not limited to a facing position.

In the embodiment, core 11 is a ferrite core, and has a size of 8×20×0.2 mm.

The number of turns of a conductive material of coil section 31 according to the embodiment is approximately 2.5 turns. Thus, a configuration may also be adopted in which the number of lines of conductive material wound around a surface that faces the electronic circuit board of core 11 (i.e., the number of lines in which the conductive material is wound over the surface that faces the electronic circuit board of core 11 when winding the conductive material around core 11) is less than a number of lines of conductive material wound around a surface on the side that is opposite to the surface that faces the electronic circuit board of core 11.

By adopting this configuration, an efficient antenna apparatus can be made with a small number of turns. A magnetic field that contributes to communication as antenna 8 mainly arises on the side opposite to the surface that faces the electronic circuit board of core 11 (see FIG. 3 that is referred to hereinafter). Accordingly, if the number of lines of conductive material, wound around the surface on a side opposite to the surface that faces electronic circuit hoard 6 of core 11 is made greater than the number of lines of conductive material wound around the surface that faces electronic circuit board 6 of core 11, a magnetic field that contributes to communication as an antenna apparatus can be generated with a smaller number of turns.

Although in FIG. 9, plate-shaped (cubic) core 11 is disposed on a loop of the antenna apparatus in a longitudinal direction of core 11, the core may also be disposed on the loop in a short-side direction of the core, and the shape of coil section 31 and core 11 can be freely selected in accordance with the desired characteristics and space to be mounted in. Corners may also be rounded or omitted.

However, when core 11 is disposed on the loop in the short-side direction of the core, coil section 31 is obviously formed by winding in the short-side direction of core 11.

The magnetic field strength increases as the number of turns increases. However, with respect to the rate of increase, the magnetic field strength increases significantly when the number of turns increases by the amount of a half turn from an integer.

However, the number of turns is not limited, and the number of turns may be greater or less than the approximately 2.5 turns illustrated in FIG. 9.

In this connection, increasing or decreasing the number of turns by approximately 0.5 turn from an integral multiple facilitates insertion of the antenna apparatus, since the two ends (connecting sections with the antenna apparatus) of coil section 31 can be placed on both sides in such a way as to hold core 11 between the two ends.

That is, insertion is facilitated since insertion can be performed in a manner such as when replacing a linear portion of a normal loop antenna.

Furthermore, in FIG. 9, distance d between an end part of antenna 8 and an end part of electronic circuit board 6 is 0 mm. Particularly, as will be understood from FIG. 11, when distance d is between 0 and 4 mm, axis X of magnetic field M inclines significantly at an angle of 55 to 80 degrees (i.e., angle α). Furthermore, even when distance d is between 8 mm and 12 mm, axis X can incline to approximately 85 degrees (i.e., angle α). This is, if antenna 8 and electronic circuit board 6 are too far apart, the influence of electronic circuit board 6 decreases and a force of electronic circuit board 6 that causes axis X of magnetic field 8 to incline recedes. The communication distance is also influenced by the size of electronic circuit board 6, and the communication distance expands in accordance with an increase in the size of electronic circuit board 6 and the length of the side on which the antenna is mounted.

In FIGS. 5 to 7, an end part of antenna 8 and an end part of electronic circuit board 6 are arranged so as to be aligned with each other, and distance d between the end part of antenna 8 and the end part of electronic circuit board 6 is 0 mm. However, an end part of antenna 8 may protrude beyond an outermost end part of electronic circuit board 6. In FIG. 9, distance D between antenna 8 and electronic circuit board 6 is 4 mm, and the distance (taken as distance d) when an end part of antenna 8 protrudes beyond an outermost end part of electronic circuit board 6 is a positive value. When the end part of antenna 8 protrudes beyond an end part of electronic circuit board 6, magnetic field 8 directly over (region A side) the electronic circuit board becomes stronger. However, if the end part of antenna 8 protrudes too much beyond the end part of electronic circuit board 6, the force of electronic circuit board 6 that causes axis X of magnetic field 8 to incline recedes. Accordingly, when d=2 mm, axis X inclines the most and is 70 degrees (i.e., angle α). However, even when the end part of antenna 8 is caused to protrude by 8 mm, axis X can be caused to incline at an angle of 85 degrees (i.e., angle α).

In addition, an end part of antenna 8 may be disposed on an inner side of an outermost end part of electronic circuit hoard 6. At this time, in FIG. 9, distance D is a negative value. If the position of the end part of antenna 8 is too far on the inner side from the outermost end part of electronic circuit board 6, magnetic field 8 on the left side (magnetic field 8 towards region Q side) in FIG. 5 is also attenuated and the entire magnetic field 8 weakens, and since the magnetic field is attenuated, axis X of magnetic field 8 approaches a perpendicular state with respect to electronic circuit board 6. Accordingly, angle $\alpha$ is 78 degrees when d=0 mm, and angle $\alpha$ is 85 degrees when d=−8 mm.

Thus, by positioning antenna 8 at an end part of electronic circuit board 6, a current flowing in electronic circuit board 6 can be utilized to the maximum. Furthermore, if angle $\alpha$ is approximately 85 degrees, the effect of the claimed invention can be obtained, and preferably angle $\alpha$ is 80 degrees or less.

Thus, the effect of the claimed invention is obtained when angle $\alpha$ that is an angle of inclination of axis X (axis at boundary between the lines of magnetic force in a direction away from antenna 8 and the lines of magnetic force in direction towards antenna 8 at time of communication) of magnetic field 8 illustrated in FIG. 5 with respect to electronic circuit board 6 is ≤85 degrees. To achieve this, as will be understood from the diagram illustrated in FIG. 11 illustrating the relationship between distance d and angle $\alpha$ of axis X of the magnetic field, it is sufficient to set d to a value within a range of −8 mm to +8 mm. In this case, the value "8 mm" is the same value as a width of 8 mm that core 11 has in coil axis direction S of coil section 31. That is, by arranging one end part of core 11 on an inner side or an outer side of one end part of electronic circuit board 6 within the range of the width in coil axis direction A at coil section 31 of core 11 from one end part of electronic circuit board 6, the effect of the claimed invention can be adequately obtained as long as at least one part of antenna 8 is arranged adjacent to or in contact with one end part of electronic circuit board 6 and a surface including the one end part.

Although an example is described here in which the width in the coil axis direction of coil section 31 of core 11 is 8 mm, angle $\alpha$≤85 degrees at which the effect of the claimed invention is obtained is not limited to this width. It has been confirmed that as long as the relevant width of core 11 is at least between 4 mm and 15 mm, angle $\alpha$ 85 degrees at which the effect of the claimed invention is obtained is established with respect to the relationship between antenna 8 and electronic circuit board 6 that is described above. It need scarcely be said that the relationship is based on the premise that in comparison to the width of core 11 in coil axis direction A of coil section 31, the width of electronic circuit board 6 in the same direction is greater.

Next, results obtained by comparing communication distances in directions towards regions P and Q between the antenna apparatus of the embodiment illustrated in FIG. 9 and the conventional antenna apparatus illustrated in FIG. 6 are described using Table 1 and Table 2.

For the present experiment, core 11 of the antenna apparatus of the embodiment illustrated in FIG. 9 was a ferrite core with a size of 8×26×0.4 mm. The number of turns of coil section 31 was 6.5 turns, and distance D between electronic circuit board 6 and antenna 8 was 4 mm. Furthermore, core 11 of the conventional antenna apparatus illustrated in FIG. 6 was a ferrite core with a size of 15×25×0.4 mm. The number of turns of coil section 31 was 2 turns, and distance D between electronic circuit board 6 and antenna 8 was 4 mm.

Table 1 shows results for a case where a communication counterpart of the antenna apparatuses illustrated in FIG. 9 and FIG. 6 was a non-contact type IC card, and Table 2 shows results for a case where the communication counterpart was a reader/writer apparatus.

TABLE 1

| | Region P direction | Region Q direction |
|---|---|---|
| FIG. 9 | 31 mm | 31 mm |
| FIG. 6 | 35 mm | 18 mm |

TABLE 2

| | Region P direction | Region Q direction |
|---|---|---|
| FIG. 9 | 48 mm | 44 mm |
| FIG. 6 | 40 mm | 23 mm |

As is clear from Table 1 and Table 2, in comparison with the conventional antenna apparatus illustrated in FIG. 6, the antenna apparatus of the embodiment illustrated in FIG. 9 can perform favorable communication in region B. In addition, it is clear that favorable communication can also be performed in region A.

In this connection, although the antenna apparatus and electronic circuit board 6 illustrated in FIG. 9 are arranged so that there is a gap of a certain amount between the antenna apparatus and electronic circuit board 6, when arranging the antenna apparatus and electronic circuit board 6 in a portable terminal and/or the like, in some cases such a gap can not be secured. In that case, the antenna apparatus and electronic circuit board 6 are arranged adjacent to each other as illustrated in FIG. 7. In FIG. 7, distance D between electronic circuit board 6 and antenna 8 is 0 mm. In this case also, similarly to the case illustrated in FIG. 9, an eddy current induced on the surface of electronic circuit board 6 produces a magnetic field in an opposite direction to carrier waves of antenna 8. Consequently, a magnetic field generated from antenna 8 and magnetic field generated from the eddy current induced on the surface of electronic circuit board 6 cancel each other out. As a result, magnetic field M generated from antenna 8 attenuates in the vicinity of electronic circuit board 6, and magnetic field 8 on a side that is away from electronic circuit board 6 (side near to region Q in FIG. 6) strengthens relatively, and hence axis X of magnetic field 8 inclines to the side that is away from electronic circuit board 6.

Furthermore, since antenna 8 is disposed at an end part of electronic circuit board 6, a magnetic field on electronic circuit board 6 side of antenna 8 (right side in FIG. 6) can be attenuated and a magnetic field on the side (left side in FIG. 6) that is away from electronic circuit board 6 of antenna 8 can be strengthened relatively. As a result, since axis X of magnetic field 8 can incline with respect to electronic circuit board 6, for example, even when a non-contact type IC card is positioned in either of region P and region Q, favorable communication can be performed.

In this case also, with respect to the inclination of the axis of magnetic field 8 (axis at boundary between the lines of magnetic force in direction away from antenna 8 and the lines of magnetic force in direction towards antenna 8 at time of communication) that is illustrated in FIG. 7 with respect to electronic circuit board 6, the same fact is established as that described above using FIG. 3. That is, to make angle $\alpha$≤85 at which the effect of the claimed invention is obtained, it is sufficient to arrange at least one part of antenna 8 adjacent to or in contact with one end part of electronic circuit board 6 and a surface including the one end part by arranging one end part of core 11 on an inner side or an outer side of one end part of electronic circuit board 6 within the range of the width in coil axis direction A at coil section 31 of core 11 from one end part of electronic circuit board 6.

Figure 12:
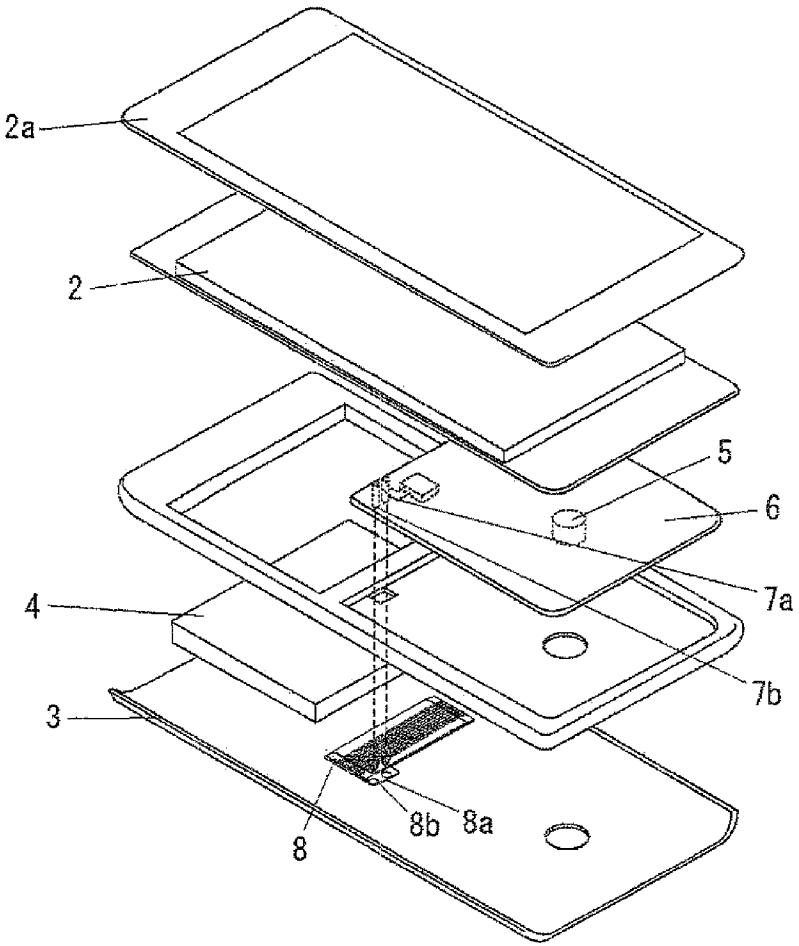
FIG. 12 is an exploded perspective view of a portable terminal in which the antenna of the claimed invention is installed at a different position to that illustrated in FIG. 1.

FIG. 12 is an exploded perspective view of a portable terminal in which the antenna of the claimed invention is mounted at a different position to FIG. 1. In FIG. 12, antenna 8 is mounted at approximately the center of back cover 3 of portable terminal 1. In this state, for example, an inclination in the lines of magnetic force generated by antenna 8 as illustrated in FIG. 6 does not occur. At this time, even if a radio communication medium (not illustrated) such as an IC card or an IC tag is arranged in a direction that is substantially orthogonal to the position at which antenna 8 of back cover 3 illustrated in FIG. 12 is arranged, communication can not be performed. Instead, if the radio communication medium is somewhat moved away in the longitudinal direction of portable terminal 1 (that is, coil axis S direction of antenna 8 illustrated in FIG. 2), communication is enabled. For example, it is advantageous to bring the radio communication medium close to a position facing battery 4. Furthermore, even if antenna 8 is placed at the center, the same effect as in FIGS. 5 to 7 can be obtained by rotating the orientation of antenna 8 by 90 degrees relative to the state illustrated in FIG. 12 to make the direction of coil axis S of antenna 8 perpendicular to electronic circuit board 6.

The adjustment pattern for performing inductance adjustment of antenna 8 in the above described embodiment of the claimed invention will now be described in detail.

Figure 13:
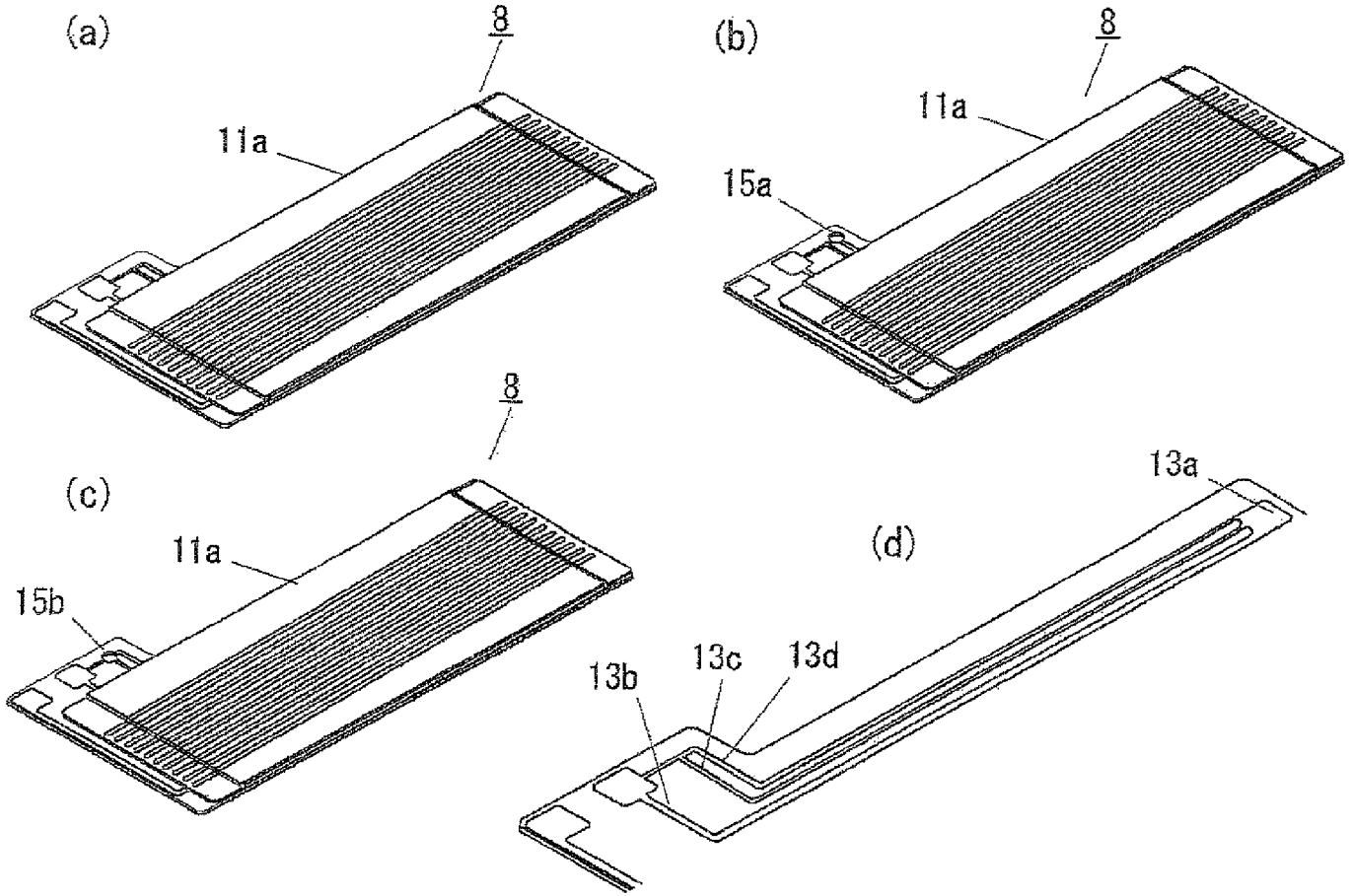
FIG. 13 is a diagram illustrating how inductance of an antenna is adjusted in Embodiment 1 of the claimed invention.

FIGS. 13(*a*) to 13(*d*) are diagrams that illustrate inductance adjustment of the antenna according to Embodiment 1 of the claimed invention. FIG. 13(*a*) is a diagram illustrating a state in which cutting has not been performed with respect to an adjustment pattern. FIG. 13(*b*) is a diagram illustrating a state in which cutting has been performed at a first cutting point of the adjustment pattern. FIG. 13(*c*) is a diagram illustrating a state in which cutting has been performed at a second cutting point of the adjustment pattern. FIG. 13(*d*) is an enlarged view of the adjustment pattern.

The inductance of antenna 8 is one factor that determines the resonance frequency of the antenna apparatus that is formed when antenna 8 illustrated in FIG. 1 is connected to electronic circuit board 6 on which antenna control section 9 such as a matching circuit is mounted. The inductance of antenna 8 having the configuration of the present embodiment is significantly influenced by variations in the size of core 11 illustrated in FIG. 2 to FIG. 4. This can be easily understood because, as described in the formula for self-inductance of a solenoid (self-inductance=magnetic permeability×square of number of turns per unit length×solenoid length×cross-sectional area), the influence of a ferrite shape corresponding to the length and cross-sectional area is expressed by a substantially proportional relationship.

Thus, since there are variations in the inductance of antenna 8, variations also arise in the resonance frequency of an antenna apparatus in which antenna 8 is mounted. By adjusting the resonance frequency within a predetermined range from a center frequency (for example, 13.56 MHz in the case of RF-ID) defined by communication standards, radio communication can be performed with a high probability and quality. At this time, if variations in the inductance of antenna 8 are decreased (for example, limited to be within ±2%), an adjustment range required for adjustment of the resonance frequency of the antenna apparatus in which antenna 8 is mounted can be decreased. Accordingly, the invention of the present application limits variations in the inductance of antenna 8 that are attributable to variations in the size of core 11 of antenna 8 by means of adjustment pattern 13.

As illustrated in FIG. 4(*a*), adjustment pattern 13 of region A and winding patterns 14*a* and 14*b* of region B are provided in antenna 8 of the invention of the present application. In adjustment pattern 13, one pattern (i.e., conductive wiring line) is divided into three conductive wiring lines along the longitudinal direction of adjustment pattern 13, namely, the adjustable conductive wiring line 13*b*, the adjustable conductive wiring line 13*c*, and the adjustable conductive wiring line 13*d*. The widths of the conductive wiring line of winding patterns 14*a* and 14*b* of region B are between 0.4 and 0.5 mm, a space between the adjacent conductive wiring lines is 0.4 to 0.5 mm, and the conductive wiring line is wound for 10 turns. With respect to the widths of the conductive wiring lines of adjustment pattern 13 of region A, the width of the adjustable conductive wiring line 13*b* on the innermost side is 0.4 to 0.5 mm, which is approximately identical with the width of each of the conductive wiring lines of winding patterns 14*a* and 14*b*. The width of the other adjustable conductive wiring lines 13*c* and 13*d* is 0.3 mm, and a space between the adjacent conductive wiring lines is 0.4 to 0.5 mm. For adjustment pattern 13, conductive wiring lines are divided into three parallel wiring lines, and the resulting adjustable conductive wiring lines 13*b* to 13*d* are connected to adjustment pattern end 13*a* and external connection terminal 8*a*. Naturally, the conductive wiring lines may be divided into two wiring lines or into four or more wiring lines, and the number of wiring lines may be adjusted in accordance with the degree of variation in the size of antenna 8. Furthermore, regardless of the number of wiring lines, it is preferable that the width of the adjustable conductive wiring line 13*b* that is on the innermost side in adjustment pattern 13 is approximately the same as the conductive wiring line widths of winding patterns 14*a* and 14*b*, and the widths of the other wiring lines such as the adjustable conductive wiring line 13*c* may be made thinner than that of the adjustable conductive wiring line 13*b*. Making the widths of the other wiring line thin in this manner makes it possible to achieve miniaturization. The reason the width of the adjustable conductive wiring line 13*b* on the innermost side in adjustment pattern 13 is made approximately the same as the conductive wiring line widths of winding patterns 14*a* and 14*b* is that, when adjusting an inductance value as described hereinafter, in some cases only the adjustable conductive wiring line 13*b* remains after cutting adjustment pattern 13 as illustrated in FIG. 13(*c*).

The adjustable conductive wiring lines 13*b* to 13*d* extend in parallel with each other in a perpendicular direction to the coil axis of antenna 8, with the adjustable conductive wiring line 13*b* being longest and the adjustable conductive wiring line 13*d* shortest. It is thereby possible to arrange the adjustable conductive wiring lines 13*b* to 13*d* in a shifted manner to facilitate cutting at locations of first cutting point 15*a* and second cutting point 15*b*. Furthermore, the adjustable conductive wiring lines 13*b* to 13*d* extend in parallel with winding patterns 14*a* and 14*b*. It is not necessarily the case that all patterns must be formed in parallel in this manner. Note that, the term "cutting" as used herein refers to disconnecting (isolating) a wiring line of a pattern by application of punching or laser machining to first cutting point 15*a* or second cutting point 15*b* and/or the like. In this connection, winding patterns 14*a* and 14*b* and the adjustable conductive wiring lines 13*b* to 13*d* are arranged so that fundamentally a large portion thereof faces (overlaps with) core 11. Since core 11 has a function to converge magnetic flux, this is done as a matter of course for obtaining efficient antenna performance.

Winding patterns 14*b* formed on upper-side flexible substrate 12*b* substantially overlap with winding patterns 14*a* formed on lower-side flexible substrate 12*a* in such a way as to hold core 11 therebetween. Accordingly, in upper-side flexible substrate 12*b*, nothing is formed in a large portion of a region overlapping with adjustment pattern 13 formed on lower-side flexible substrate 12*a*. Naturally, winding patterns 14*b* may also be formed at that portion.

Next, a method of adjusting the inductance value is described. In the present embodiment, since adjustment pattern 13 is divided into three parts, namely, the adjustable conductive wiring lines 13*b* to 13*d*, there are two cutting points, i.e. first cutting point 15*a* and second cutting point 15*b*. That is, when adjustment pattern 13 is divided into n parts, cutting points are formed at (n−1) places, and the inductance value is adjusted depending on whether any one of places at those cutting points is cut or is not cut.

In FIG. 13(*a*) to FIG. 13(*c*), distances to end part 11*a* of core 11 from the adjustable conductive wiring lines 13*b* to 13*d* that are treated as a single conductive wiring line by being connected to adjustment pattern end 13*a* and external connection terminal 8*a* are respectively different. Furthermore, the adjustable conductive wiring lines 13*b* to 13*d* and end part 11*a* of core 11 are approximately parallel, and may be arranged in a relationship in which the adjustable conductive wiring lines 13*b* to 13*d* and end part 11*a* of core 11 are inclined with respect to each other up to an angle of approximately plus/minus 45 degrees, but at least are not in a perpendicular relationship.

In FIG. 13(*a*), none of the three the adjustable conductive wiring lines 13*b* to 13*d* are cut. Accordingly, adjustment pattern 13 acts as a single thick conductive wiring line disposed close to end part 11*a* of core 11, and the adjustable conductive wiring line 13*d* is the outermost conductive wiring line of the coil pattern. Furthermore, the distance from outermost adjustable conductive wiring line 13*d* to end part 11*a* of core 11 is short.

In FIG. 13(*b*), adjustment pattern 13 is cut (isolated) at first cutting point 15*a*. Therefore, in adjustment pattern 13, the adjustable conductive wiring lines that are actually functioning are only the adjustable conductive wiring lines 13*b* and 13*c*. As a result, the adjustable conductive wiring line 13*c* becomes the outermost conductive wiring line of the coil pattern, and the distance from outermost adjustable conductive wiring line 13*c* to end part 11*a* of core 11 increases in comparison to FIG. 13(*a*).

In FIG. 13(*c*), adjustment pattern 13 is cut at second cutting point 15*b*. Therefore, in adjustment pattern 13, the only adjustable conductive wiring line that is actually functioning is the adjustable conductive wiring line 13*b*. As a result, the adjustable conductive wiring line 13*b* becomes the outermost conductive wiring line of the coil pattern, and the distance from outermost adjustable conductive wiring line 13*b* to end part 11*a* of core 11 increases in comparison to FIGS. 13(*a*) and 13(*b*).

With respect to antenna coils having the structure of the claimed invention in which a coil is wound around a core, since both end portions of the core around which the coil is not wound serve as the exit/entrance of magnetic flux of the antenna, when antenna coils have the same number of turns, there is a tendency for the inductance value to increase in accordance with an increase in the size of the exit/entrance of magnetic flux. FIG. 13(*a*) shows a state in which the exit/entrance of magnetic flux is smallest, and FIG. 13(*c*) shows a state in which the exit/entrance of magnetic flux is largest.

Thus, the size of the exit/entrance of magnetic flux changes according to differences in the respective distances from the adjustable conductive wiring lines 13*b* to 13*d* to end part 11*a* of core 11, and as a result the inductance value of antenna 8 can be adjusted.

Furthermore, in the case of both FIG. 13(*b*) and FIG. 13(*c*), it is sufficient to cut one place. That is, regardless of how many wiring lines into which adjustment pattern 13 is divided, both ends of the plurality of adjustable conductive wiring lines 13*b*, 13*c*, and 13*d* are connected at adjustment pattern end 13*a* side and external connection terminal 8*a* side, and are aligned in parallel. Therefore, it is sufficient to set the length of the coil pattern as well as the number of adjustable conductive wiring lines (from the inner side of core 11) to be left as adjustment pattern 13 and the number of adjustable conductive wiring lines (from the outer side of core 11) to be disconnected so that a distance between end part 11*a* of core 11 and adjustment pattern 13 becomes a desired distance, and to cut only one place therebetween. Thus, since adjustable conductive wiring lines that are left as adjustment pattern 13 are always disposed on the inner side of core 11 and adjustable conductive wiring lines that are disconnected are always disposed on the outer side of core 11, cutting need only be performed at one place and thus the inductance value of antenna 8 can be easily adjusted. Naturally, a configuration can also be adopted in which, for example, an adjustable conductive wiring line to be disconnected is disposed between the adjustable conductive wiring lines to be left as adjustment pattern 13, but this configuration requires a plurality of cutting points are required.

FIG. 2 illustrates a case where, when antenna 8 is disposed in the vicinity of an end part of electronic circuit board 6, adjustment pattern 13 is disposed so as to be positioned further on the inner side of electronic circuit board 6 than winding patterns 14*a*. However, adjustment pattern 13 may be disposed so as to be positioned further on the outer side of electronic circuit board 6 than winding patterns 14*a*. However, since miniaturization is facilitated when cutting points 15*a* and 15*b* are positioned close to external connection terminals 8*a* and 8*b*, by arranging adjustment pattern 13 further on the inner side of electronic circuit board 6 than winding patterns 14*a*, connection of external connection terminals 8*a* and 8*b* to other components can be facilitated. Note that, since it is not necessary for cutting points 15*a* and 15*b* and external connection terminals 8*a* and 8*b* to be arranged so as to overlap with core 11, these components are disposed outside core 11. Since cutting points 15*a* and 15*b* are places that are cut by punching or laser beam machining, cutting will be difficult if cutting points 15*a* and 15*b* are disposed so as to overlap with core 11. Moreover, since the portion of external connection terminals 8*a* and 8*b* is not directly related to the inductance value, it is not necessary for that portion to overlap with core 11, and it is advantageous for the region of the coil section (winding pattern) over core 11 to be increased by the corresponding amount. That is, by arranging cutting points 15*a* and 15*b* and external connection terminals 8*a* and 8*b* so as not to overlap with core 11, both miniaturization of core 11 and improvement of the inductance value of antenna 8 can be achieved in a compatible manner.

If the number of line into which adjustment pattern 13 is increased and region A of adjustment pattern 13 as a single pattern becomes too large, the size of antenna 8 will increase. Therefore, although the configuration will also depend on a desired adjustment range of the inductance value, as a guide, by setting a ratio of the width of region A to the width of region B to be a ratio of 80% (approximately 70 to 90%) to 20% (approximately 10 to 30%), miniaturization can be realized and an adequate inductance value adjustment range can also be obtained.

The following results were obtained when inductance adjustment was performed as illustrated in FIG. 13 using antenna 8 illustrated in FIG. 2 and/or the like.

Table 3 below shows results obtained by studies conducted with respect to a model of a slightly different size to that illustrated in FIG. 2 and/or the like, in which a ferrite core size was 40×12×0.3 mm, the number of turns was 8, and a conductive wiring line was divided into three parallel patterns among which only a pattern on an outermost side was adopted as an adjustment pattern. The results are for inductance value adjustment in three cases, namely, free space (not adjacent to a metal body), a case where adjustment pattern 13 intimately faces a metal body (for example, electronic circuit board 6), and a case where adjustment pattern 13 does not face a metal body. For each case, inductance value L, an amount of change in inductance value L produced by cutting, and a rate of change are illustrated with respect to a case where cutting was not performed, a case where cutting was performed at cutting point 15*a*, and a case where cutting was performed at cutting point 15*b*. At this time, the amount of change and the rate of change are calculated on the basis of a case in which cutting is not performed.

TABLE 3

| | | L(nH) | L change amount (nH) | L rate of change |
|---|---|---|---|---|
| Free space | No trimming | 3102.38 | 0.00 | 0.00% |
| | 15aTrimming | 3163.37 | 60.99 | 1.97% |
| | 15bTrimming | 3219.9 | 117.52 | 3.79% |
| Adjustment pattern: metal side | No trimming | 2243.18 | 0.00 | 0.00% |
| | 15aTrimming | 2240.62 | −2.56 | −0.11% |
| | 15bTrimming | 2239.24 | −3.94 | −0.18% |
| Adjustment pattern: back side of metal | No trimming | 2123.46 | 0.00 | 0.00% |
| | 15aTrimming | 2209.71 | 86.25 | 4.06% |
| | 15bTrimming | 2282.64 | 159.18 | 7.50% |

As will be understood from Table 3, in the case where antenna 8 was disposed in a free space and the case where antenna 8 was not disposed close to a metal body (a metal body did not affect antenna 8), the inductance value fluctuated by a maximum of a little less than 4%, and an adjustment of that amount was possible.

Next, lower-side flexible substrate 12*a* including adjustment pattern 13 was arranged so as to intimately face a metal body. A gap between the metal body and the pattern at this time was set to 30 μm. In this case, the influence of the adjacent metal body on the size of the exit/entrance of magnetic flux increased, the influence of adjustment pattern 13 almost disappeared, and the inductance value fluctuated by a maximum of a little less than 0.2%. That is, this configuration is useful in a case where just a minor inductance value adjustment is required.

Lastly, lower-side flexible substrate 12*a* including adjustment pattern 13 was arranged so as not to face the metal body. That is, the arrangement relationship was as described in FIG. 2. In this case, the gap between the metal body and the coil pattern of the antenna was set to 30 μm, similarly to the above described case. At this time, the size of the exit/entrance of magnetic flux was influenced by both of the adjacent metal body and adjustment pattern 13, and the inductance value fluctuated by a maximum of 7.5%. That is, a variation in the inductance value of antenna 8 caused by a variation in the size of core 11 and/or the like can be adjusted over a wide range, and the allowable range of inductance adjustment increases.

Based on the above results, it is found that whether adjustment pattern 13 is arranged so as to face metal or is arranged so as not to face metal, respectively different benefits are obtained. Accordingly, adjustment pattern 13 may be provided on both lower-side flexible substrate 12*a* and upper-side flexible substrate 12*b*, or may be provided on one of lower-side flexible substrate 12*a* and upper-side flexible substrate 12*b*. However, when providing adjustment pattern 13 on both surfaces, it is advantageous to form adjustment patterns 13 so that the cutting points do not overlap, for example, by forming the cutting points on the left and right of the coil patterns, respectively.

Figure 14:
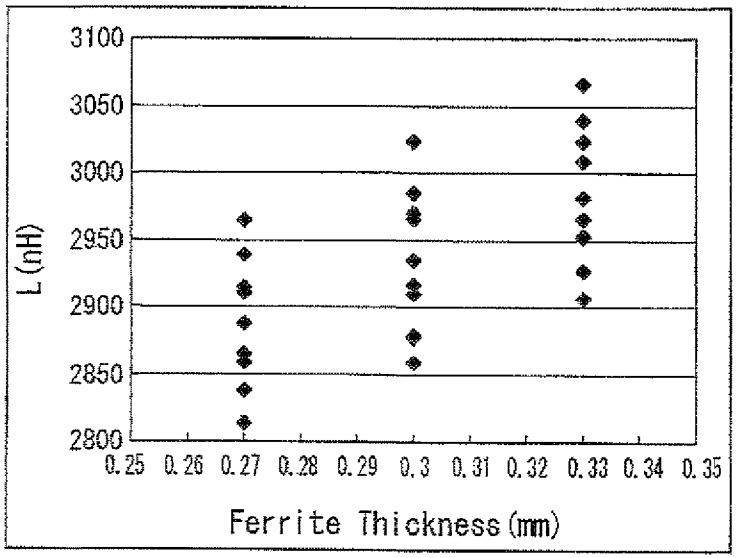
FIG. 14 is a diagram illustrating results of adjusting the inductance value of the antenna according to Embodiment 1 of the claimed invention.
Figure 14:
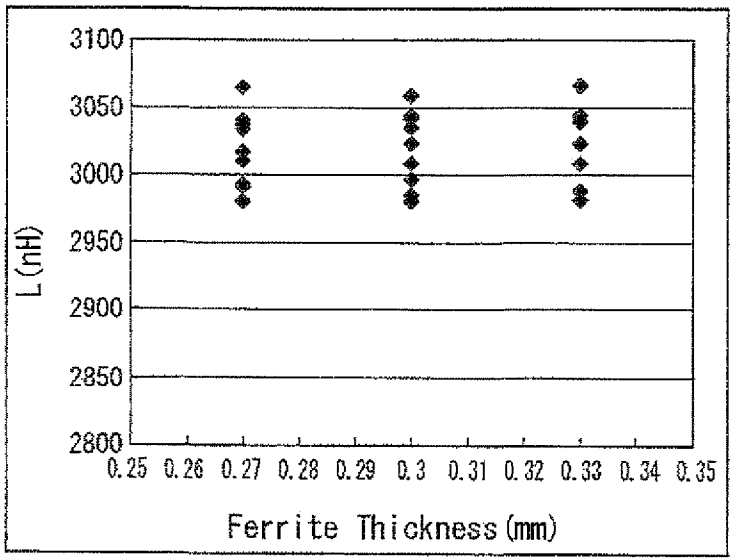
Figure 15:
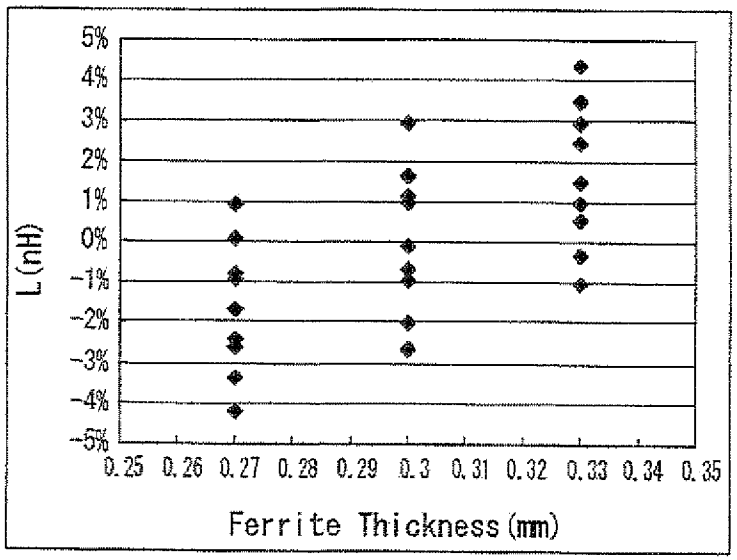
FIG. 15 is a diagram illustrating results of adjusting variations in the inductance value of the antenna according to Embodiment 1 of the claimed invention.
Figure 15:
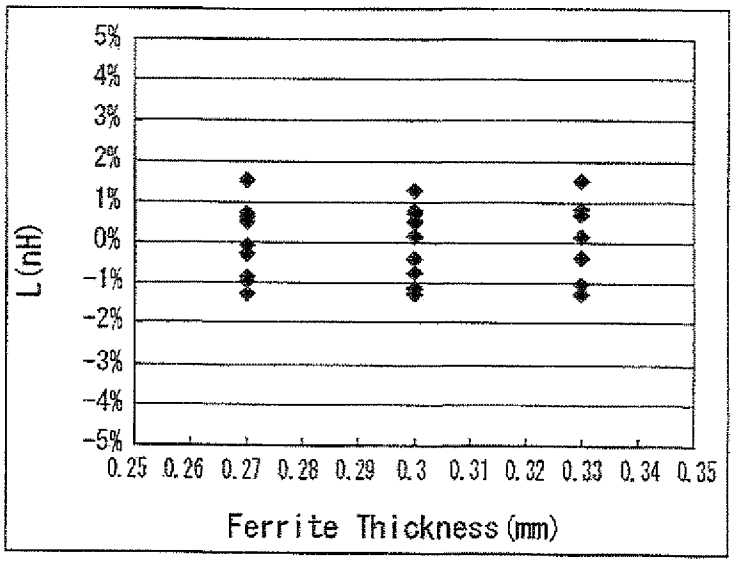

FIG. 14 is a diagram illustrating results of adjusting inductance values of the antenna according to Embodiment 1 of the claimed invention. FIG. 15 is a diagram illustrating results of adjusting variations in inductance values of the antenna according to Embodiment 1 of the claimed invention. Note that, adjustment pattern 13 in this case is arranged so as not to face the metal body (electronic circuit board 6). The studies of FIG. 14 and FIG. 15 were performed using an antenna model of the size and shape illustrated in FIG. 2 and FIG. 3 and/or the like.

FIG. 14(*a*) shows the relationship between the thickness of core 11 and inductance values when cutting was not performed as illustrated in FIG. 13(*a*), in a case where the size of core 11 was changed within ranges of a lateral width of 33.2 to 33.8 mm (width in X direction in FIG. 2), a vertical width of 13.4 to 14 mm (width in Y direction in FIG. 2), and a thickness of 0.27 to 0.33 mm, respectively. FIG. 14(*b*) shows inductance values in a case where, under the same circumstances as FIG. 14(*a*), cutting (adjustment) was appropriately performed so that a distribution range of the overall inductance values described in FIG. 14(*a*) became the smallest range. That is, FIG. 14(*a*) shows results before inductance value adjustment by cutting, and FIG. 14(*b*) shows results after inductance value adjustment by cutting.

FIG. 15(*a*) shows the degree of variation in each inductance value described in FIG. 14(*a*) with respect to a mean inductance value of the overall inductance values described in FIG. 14(*a*). That is, FIG. 15(*a*) shows the relationship between the thickness of core 11 and variations in the inductance value before inductance value adjustment by cutting.

FIG. 15(*b*) shows the degree of variation in each inductance value described in FIG. 14(*b*) with respect to a mean inductance value of the overall inductance values described in FIG. 14(*b*). That is, FIG. 15(*b*) shows the relationship between the thickness of core 11 and variations in the inductance value after inductance value adjustment by cutting.

As will be understood from FIG. 14(*a*) and FIG. 15(*a*), if no inductance value is adjusted, a variation of only approximately plus/minus 1 to 2% in the X-direction width and Y-direction width of core 11 leads variations in the inductance values by approximately plus/minus 5%. To produce a practical antenna 8, for example, even if the X-direction width and Y-direction width of core 11 vary by approximately plus/minus 1 to 2%, it is necessary for variations in the inductance value to remain within a range of approximately plus/minus 2%.

The above problem can be solved by forming adjustment pattern 13 as in the claimed invention.

Since FIG. 14(*a*) relates to inductance values of antenna 8 described in FIG. 13(*a*), the inductance values become comparatively lower as described above. That is, according to the inductance value adjustment of the claimed invention, inductance values are adjusted in an increasing direction when the state in which cutting is not performed that is illustrated in FIG. 13(*a*) is taken as a basis. As described in FIG. 14(*a*), inductance values increase as the thickness of core 11 increases. On the other hand, FIG. 14(*b*) shows that, by performing inductance value adjustment by cutting, inductance values can be made substantially the same level irrespective of the thickness of core 11.

Moreover, as is also clear from FIG. 15(*a*) and FIG. 15(*b*), it was found that the degree of variation in inductance values decreases as the result of cutting.

Figure 16:
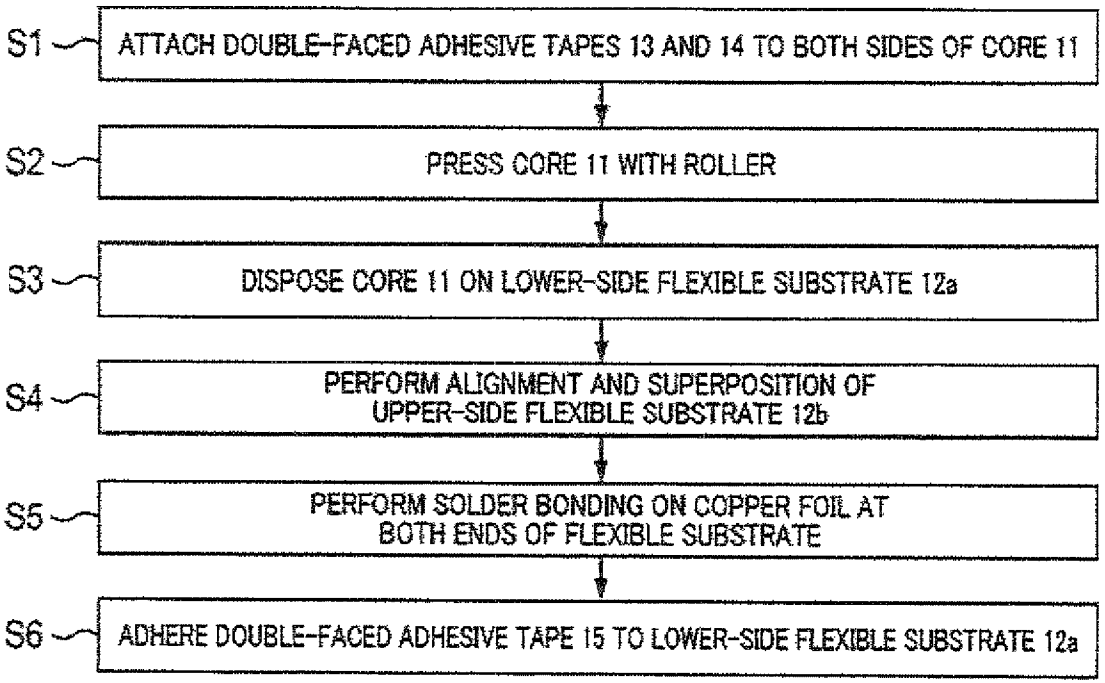
FIG. 16 is a diagram illustrating an example of a manufacturing process of the antenna according to Embodiment 1 of the claimed invention.

FIG. 16 is a diagram illustrating an example of a manufacturing process for the antenna according to Embodiment 1 of the claimed invention. This manufacturing process will now be described while referring also to the exploded perspective view illustrated in FIG. 3.

As mentioned above, although not illustrated in the drawings, slits having a pitch of several mms are formed in at least one of the surfaces facing lower-side flexible substrate 12*a* and upper-side flexible substrate 12*b* of core 11 as illustrated in FIG. 3. The slits are formed prior to a firing process when producing core 11. In a preliminary step before the firing process, slits are formed with a size and depth of a degree such that core 11 does not break easily at a portion in which a slit is formed after firing.

A double-faced adhesive tape is attached to a side that is to face lower-side flexible substrate 12*a* or upper-side flexible substrate 12*b* of core 11 in which slits are provided and for which a firing process has been completed (step S1 in FIG. 16). According to the present embodiment, double-faced adhesive tape is attached to both sides of core 11.

As is known, to facilitate handling, a double-faced adhesive tape is in a state in which the respective single faces thereof are supported by a support film. Naturally, in step S1 in FIG. 16, each of the support films remains on the double-faced adhesive tape in a state in which the double-faced adhesive tape is attached to both sides of core 11 that is illustrated in FIG. 3. In this state, either one of the sides to which double-faced adhesive tape is attached of core 11 is pressed by means of, for example, a roller and/or the like (step S2 in FIG. 16).

Thereupon, at least a part of core 11 is divided by the slits, and core 11 enters a state in which core 11 is constituted by a plurality of small pieces. However, since the protective tape (i.e., double-faced adhesive tape) is attached to both sides of core 11, core 11 does not fall apart. Even if a place where antenna 8 is to be attached on back cover 3 of portable terminal 1 illustrated in FIG. 1 has a curved face, it is possible to attach and arrange core 11 that is in the above described state along the curved face.

Furthermore, when assembling antenna 8 or when mounting antenna 8 to portable terminal 1 (see FIG. 1) and/or the like, in some cases a worker may exert unintended stress onto core 11. At this time also, it is possible to prevent a situation in which some small pieces of core 11 that is divided by the slits drop off and the small pieces that dropped off or residue scatter inside a communication apparatus in which antenna 8 is mounted (for example, portable terminal 1 in FIG. 1). It is thus possible to prevent an adverse effect on the communication apparatus.

Furthermore, the aforementioned support film of the double-faced adhesive tape illustrated in FIG. 3 prevents the double-faced adhesive tape from attaching to the roller or a work bench that faces the roller when the double-faced adhesive tape is pressed by the roller.

Note that a double-faced adhesive tape is attached to the side of lower-side flexible substrate 12*a*, which is opposite to the side on which core 11 is arranged, after arrangement and alignment of upper-side flexible substrate 12*b* and soldering with lower-side flexible substrate 12*a*, which are described hereinafter are completed. In this manner, it is made possible to use an inexpensive double-faced adhesive tape material that cannot withstand heat that is applied during soldering, and thus eliminates the need for use of an expensive heat-resistant tape.

As described above, core 11 that is capable of bending to some extent is disposed on lower-side flexible substrate 12*a* (step S3 in FIG. 16). At this time, core 11 is disposed on lower-side flexible substrate 12*a* after peeling off the support film of the double-faced adhesive tape that is attached to the surface facing lower-side flexible substrate 12*a* of core 11. The place at which core 11 is disposed is inside the portion indicated by the dotted line in FIG. 4(*a*).

After core 11 illustrated in FIG. 3 is disposed on lower-side flexible substrate 12*a* in this manner, next, upper-side flexible substrate 12*b* is disposed on the upper side of core 11. In this case also, upper-side flexible substrate 12*b* is disposed on the upper side of core 11 after peeling off the support film of the double-faced adhesive tape that is attached to the surface facing upper-side flexible substrate 12*b* of core 11. Alignment of upper-side flexible substrate 12*b* is performed so as to arrange core 11 inside the dotted line illustrated in FIG. 4(*b*) (step S4 in FIG. 16).

Several methods are available with respect to alignment of tower-side flexible substrate 12*a* on which core 11 has been arranged and upper-side flexible substrate 12*b*. For example, although not illustrated in the drawings of the present embodiment, holes of alignment pins or markers are provided in advance on the outer edges of lower-side flexible substrate 12*a* and upper-side flexible substrate 12*b*, and alignment is performed using the holes or markers. Subsequently, after performing soldering of lower-side flexible substrate 12*a* and upper-side flexible substrate 12*b* that is described hereinafter, a hole portion or marker portion that becomes no longer necessary may be removed. Thus, alignment between pattern exposing sections 17*a* and 19*a* and pattern exposing sections 17*b* and 19*b* is facilitated, and flexible substrate 12 in which a coil pattern is formed for performing communication with radio communication media such as IC cards or IC tags can be assembled more securely. In a case where a hole or marker portion cannot be provided, a method is also available that aligns upper-side flexible substrate 12*b* and lower-side flexible substrate 12*a* using an image recognition apparatus or a robot and/or the like.

After performing alignment in this manner, solder bonding of lower-side flexible substrate 12*a* and upper-side flexible substrate 12*b* is performed (step S5 in FIG. 16). At this time, the positions of the copper foil at both ends of the respective divided patterns exposed by pattern exposing sections 19*a* and 19*b* of upper-side flexible substrate 12*b* and the positions of the copper foil at both ends of the respective divided patterns exposed by pattern exposing sections 17*a* and 17*b* of lower-side flexible substrate 12*a* match. That is, in FIG. 3, the positions of the respective copper foils match, and a single coil pattern is formed by performing soldering of lower-side flexible substrate 12*a* and upper-side flexible substrate 12*b*.

Soldering is performed by heating a portion at which pattern exposing sections 17*a* and 19*a* overlap and a portion at which pattern exposing sections 17*b* and 19*b* overlap. As described above, a solder plating process is performed in advance on copper foils at the respective two ends of divided patterns exposed by pattern exposing sections 19*a* and 19*b* of upper-side flexible substrate 12*b*. Furthermore, a gold plating process is performed in advance on copper foils at the respective two ends of divided patterns exposed by pattern exposing sections 17*a* and 17*b* provided on lower-side flexible substrate 12*a*. Accordingly, when the relevant portions are heated, solder plated on copper foils of upper-side flexible substrate 12*b* fuses so that joining is performed with copper foils of lower-side flexible substrate 12*a*.

Note that, since the double-faced adhesive tape is susceptible to heat, to avoid applying heat to the double-faced adhesive tapes, only a portion at which pattern exposing sections 17*a* are 19*a* overlap and a portion at which pattern exposing sections 17*b* and 19*b* overlap are heated. A heating apparatus may be drawn up from flexible substrate 12, after the solder is fused, joining of copper foils of upper-side flexible substrate 12*b* and copper foils of tower-side flexible substrate 12*a* is performed, and the solder is cooled and fixed. As a heating method that requires minute temperature control that is local and quick in this manner, for example, joining that uses pulse heat is suitable.

However, joining of lower-side flexible substrate 12*a* and upper-side flexible substrate 12*b* that is performed using only solder produced by a solder plating process executed on pattern exposing sections 19*a* and 19*b* of upper-side flexible substrate 12*b* is insufficient in some cases. In such a case, a solder cream layer may be formed at either the respective two end parts of divided patterns of pattern exposing sections 17*a* and 17*b* of lower-side flexible substrate 12*a* or the respective two end parts of divided patterns on upper-side flexible substrate 12*b*.

Note that, an ACF (anisotropic conductive film) may be used instead of the above described soldering. That is, before the above described step S4 in FIG. 16, an ACF is attached to either pattern exposing sections 17*a* and 17*b* of lower-side flexible substrate 12*a* or pattern exposing sections 19*a* and 19*b* of upper-side flexible substrate 12*b* that are illustrated in FIG. 3. In this case, the above described step S5 in FIG. 16, that is, the soldering process, is not required.

Lastly, a double-faced adhesive tape is adhered to the side of lower-side flexible substrate 12*a*, which is opposite to the side on which core 11 is arranged of (step S6 in FIG. 16). As described above, the reason for this is that the double-faced adhesive tape can not withstand heat that is applied when soldering. As is known, to facilitate handling, a double-faced adhesive tape is in a state in which the respective single faces thereof are supported by a support film. Naturally, in step S6 in FIG. 16, in a state in which the double-faced adhesive tape is attached to lower-side flexible substrate 12*a* of antenna 8 that is illustrated in FIG. 3, the support film remains attached thereto. The support film, for example, is peeled off before mounting the completed antenna 8 that has undergone the above described process to portable terminal as illustrated in FIG. 1.

Antenna 8 illustrated in FIG. 2 can be assembled extremely simply and with high precision using the process described above. As illustrated using FIG. 3 and FIG. 16, since a configuration is adopted in which the double-faced adhesive tape is attached in advance to both flat surfaces of core 11 and soldering is performed after performing alignment with flexible substrate 12, even if a mistake occurs in alignment of the core, it is possible to perform the alignment again before performing soldering. It is thereby possible to lower the assembly defect rate with respect to antenna 8 illustrated in FIG. 2.

Embodiment 2

In antenna 108 of Embodiment 2, the configuration of an adjustment pattern is different to that of antenna 8 of Embodiment 1. The remaining configuration is basically the same as in Embodiment 1 unless described in particular below.

Figure 17:
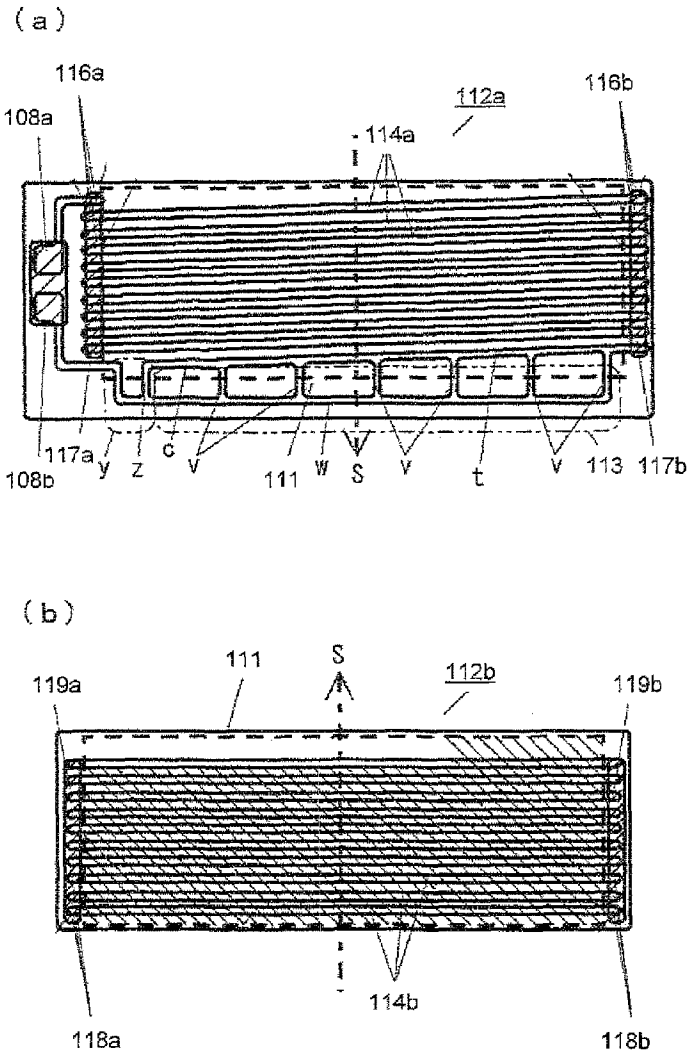
FIG. 17 is a diagram illustrating a flexible substrate according to Embodiment 2 of the claimed invention.

FIGS. 17(*a*) and 17(*b*) are diagrams illustrating a flexible substrate according to Embodiment 2 of the invention of the present application. FIG. 17(*a*) is a diagram illustrating lower-side flexible substrate 112*a* as seen from a contact surface with core 111, and FIG. 17(*b*) is a diagram illustrating upper-side flexible substrate 112*b* as seen from a contact surface with core 111.

Winding patterns 114*a* and 114*b* formed on flexible substrates 112*a* and 112*b* of the present embodiment are not only helical coil patterns. As illustrated in FIG. 17(*a*), adjustment pattern 113 that is described in more detail hereunder is provided that is connected to divided pattern t that is positioned on one side of an outermost edge portion. Adjustment pattern 113 has a plurality of lead-out patterns v in which end parts on one side are connected to divided pattern t. Adjustment pattern 113 also has connection pattern w that links and is connected with respective end parts on another side that is not connected to divided pattern t of lead-out patterns v, and a protrusion-side end part (end part positioned on the outside of the exterior of core 111 that is indicated by a dotted line) of protrusion section lead-out pattern z constituting part of protrusion section y of divided pattern t. The positions of copper foils 116*a* and copper foils 118*a*, and the positions of copper foils 116*b* and copper foils 118*h* match, and a single coil pattern is formed around winding axis S when soldering of lower-side flexible substrate 112*a* and upper-side flexible substrate 112*b* is performed.

In the embodiment, adjustment pattern 113 is provided on only tower-side flexible substrate 112*a* side. On the other hand, the plurality of winding patterns 114*a* and 114*b* forming the coil patterns illustrated in FIGS. 17(*a*) and (*b*) are provided in a divided manner on both lower-side flexible substrate 112*a* and upper-side flexible substrate 112*b*. In addition to adjustment pattern 113, external connection terminals 108*a* and 108*b* are also provided on lower-side flexible substrate 112*a*, and lower-side flexible substrate 112*a* has a larger exterior than upper-side flexible substrate 112*b*. These parts of adjustment pattern 113 (that is, all of connection pattern w and part of lead-out patterns v), a part of protrusion section y of divided pattern t, and external connection terminals 108*a* and 108*b* are disposed at positions that are further to the outer side than the exterior of core 111 that is illustrated by a dotted line and upper-side flexible substrate 112*b*. In other words, it can be said that these parts of adjustment pattern 113 are disposed at positions that, are outside of the outer circumference of core 111 and upper-side flexible substrate 112*b*.

Thus, since external connection terminals 108*a* and 108*b* are not covered over by core 111 and upper-side flexible substrate 112*b* when assembly of antenna 108 is completed, as illustrated in FIG. 1, antenna 108 can be connected to electronic circuit board 6 that is disposed, on a surface facing antenna 108, and an antenna apparatus can be constituted as a result of such connection.

Furthermore, adjustment pattern 113 that is not covered by core 111 and upper-side flexible substrate 112*b* has at least connection pattern w. The inductance of antenna 108 can be adjusted when assembly of antenna 108 is completed by disconnecting either plurality of lead-out patterns v constituting the adjustment pattern or protrusion section lead-out pattern z constituting part of protrusion section y of divided pattern t by cutting and/or the like.

Cutting of the coil pattern for adjusting the inductance of antenna 108 is performed at a portion that is further on an outer side than the exterior of core 111 that is illustrated by a dotted line among lead-out patterns v and protrusion section lead-out pattern z in FIG. 17. Since these portions are not covered by core 111 and upper-side flexible substrate 112, cutting work can be performed with ease.

For example, a difference between the number of turns of a coil pattern that is wound around core 111 with respect to a case where only protrusion section lead-out pattern z in FIG. 17 is left and lead-out patterns v are all cut off and a case where only lead-out pattern v adjacent to protrusion section lead-out pattern z is left and the other portions are all cut off is "c." The inductance of antenna 108 varies by an amount that corresponds to that difference.

Note that, in FIG. 17, protrusion section y that is positioned further on the outside than the exterior of core 111 need not necessarily be provided in divided pattern t constituting the coil pattern. However, if protrusion section y is provided, as described above, protrusion section lead-out pattern z that constitutes part of protrusion section y also contributes to adjustment of the inductance of the coil pattern. When divided pattern t that constitutes the coil pattern has protrusion section y that is positioned further on the outside than the exterior of core 111, even when antenna 108 illustrated in FIG. 2 is a small size, it is possible to adequately secure an adjustment margin with respect to the inductance of the coil pattern. Furthermore, since protrusion section y in FIG. 17 is a portion that contributes to adjustment of the inductance of the coil pattern together with adjustment pattern 113, protrusion section y must be on the flexible substrate of the same side as adjustment pattern 113 is provided on. In the embodiment, protrusion section y is provided on lower-side flexible substrate 112*a* together with adjustment pattern 113.

Figure 18:
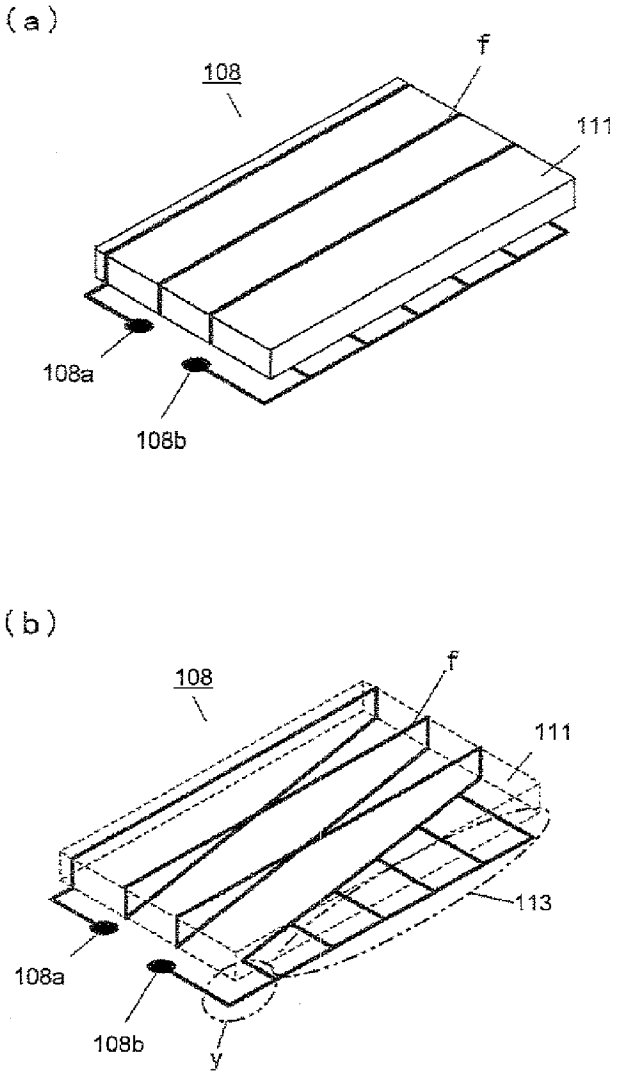
FIG. 18 is a perspective view schematically illustrating an antenna according to Embodiment 2 of the claimed invention.
Figure 19:
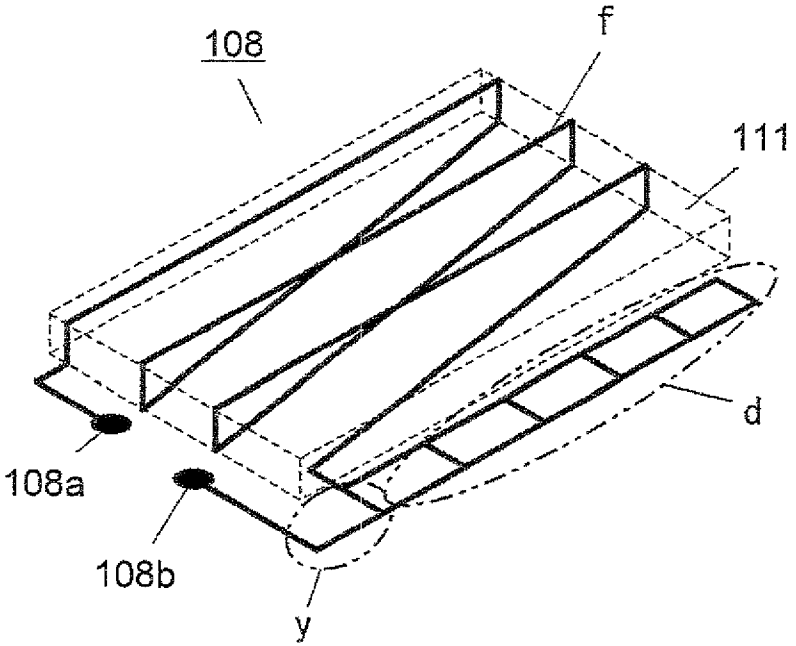
FIG. 19 is a diagram illustrating a comparative example with respect to the antenna according to Embodiment 2 of the claimed invention described in FIG. 18.

FIGS. 18(*a*) and (*b*) are perspective views that schematically show the antenna of Embodiment 2 of the claimed invention. FIG. 18(*a*) is an external perspective view that schematically shows the antenna of an embodiment of the claimed invention, and FIG. 18(*b*) is a transparent perspective view for providing a schematic understanding of the state of winding of an antenna coil and an adjustment pattern of the antenna of the embodiment of the claimed invention illustrated in FIG. 18(*a*). FIG. 19 is a diagram illustrating a comparative example with respect to the antenna of the embodiment of the claimed invention illustrated in FIGS. 18(*a*) and (*b*).

As described above with respect to FIG. 17, in FIG. 18(*b*) in particular, part of adjustment pattern 113, part of protrusion section y of coil pattern f that represents winding patterns 114*a* and 114*b* in a simplified manner, and external connection terminals 108*a* and 108*b* are arranged further on the outer side than the exterior of core 111 that is illustrated by a dotted line. In other words, it can be said that these parts of adjustment pattern 113 are disposed at positions that are outside of the outer circumference of core 111. Note that coil pattern f in FIG. 18 is a pattern that is constituted by winding patterns 114*a* and 114*b* illustrated in FIG. 17. However, although the number of turns of a coil pattern that is actually constituted by winding patterns 114*a* and 114*b* is 10 turns, coil pattern f illustrated in FIG. 18 is depicted in a manner in which the number of turns is abbreviated. With respect to adjustment pattern 113 illustrated in FIG. 18 also, although the number of lead-out wiring line from coil pattern f positioned below core 111 is different to that of adjustment pattern 113 illustrated in FIG. 17, the reason is also that the adjustment pattern 113 illustrated in FIG. 18 is depicted in a simplified manner.

On the other hand, adjustment pattern d provided in antenna 108*c* illustrated in FIG. 19 is a pattern for adjusting the inductance of antenna 108*c* in which the overall line length of the antenna coil is changed in a manner that is conventionally used. With the exception of this difference in the adjustment patterns, there is no difference between antenna 108*c* of the comparative example illustrated in FIG. 19 and antenna 108 of the embodiment of the claimed invention illustrated in FIG. 18. However, in antenna 108 of FIG. 18 and antenna 108*c* of FIG. 19 that have the above described configurations, the line length of the portion that is wound around core 111 of the antenna coil predominantly determines the overall inductance of the antenna. Therefore, as in the embodiment, when the number of turns of coil pattern f increases to approximately 10 turns, in the conventional adjustment pattern d illustrated in FIG. 19 the adjustment pattern can not contribute significantly to adjustment of the inductance that antenna 108*c* has overall.

However, in the case of adjustment pattern 113 provided in antenna 108 illustrated in FIG. 18, irrespective of where a position of cutting generated as a result of adjusting the inductance of antenna 108 is, since the overall line length of the antenna coil is approximately constant and only the line length of a portion wound around core 111 is variable, adjustment of the inductance is enabled. That is, in FIG. 18, the line length from one external connection terminal 108*a* to the other external connection terminal 108*b* is approximately constant. The fact that the inductance of antenna 108 overall can be adjusted while maintaining the overall line length of the antenna coil at an approximately constant length is a feature of antenna 108 according to this embodiment of the claimed invention.

Next, a method of cutting adjustment pattern 113 provided in antenna 108 illustrated in FIG. 18 is described.

Figure 20:
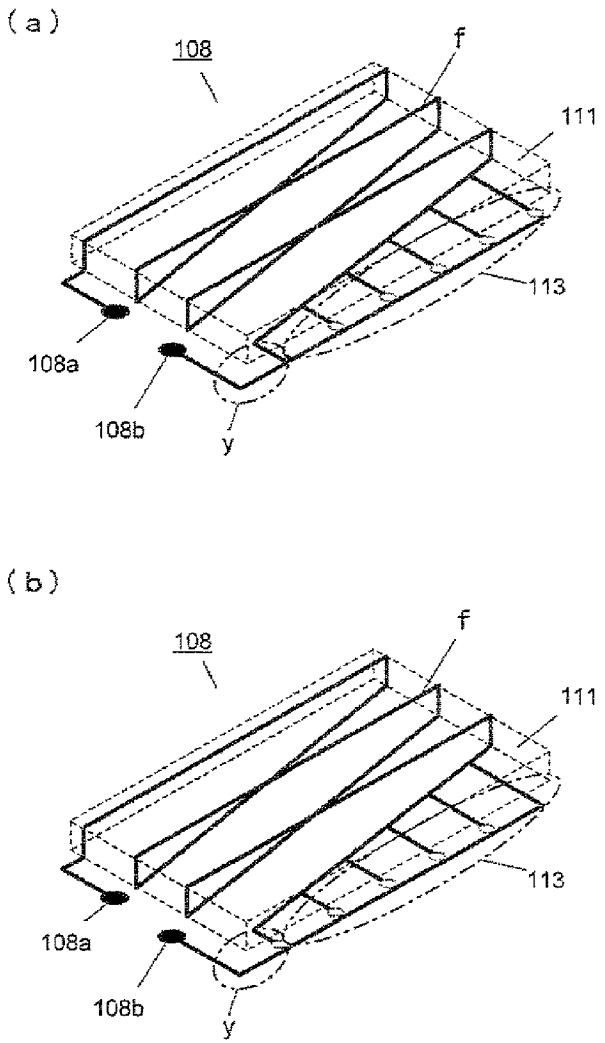
FIG. 20 is a diagram illustrating a cutting example of an adjustment pattern provided in the antenna illustrated in FIG. 18.
Figure 21:
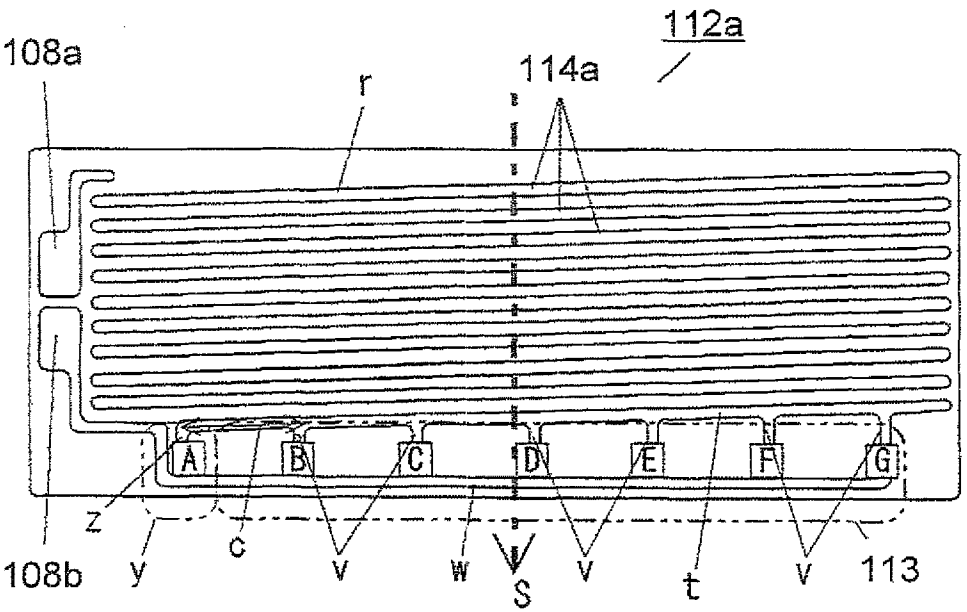
FIG. 21 is a diagram illustrating an example of cutting positions of an adjustment pattern in a flexible substrate on an underside of the antenna illustrated in FIG. 17(*a*), that corresponds to the antenna schematically illustrated in FIG. 20.

FIGS. 20(*a*) and (*b*) are diagrams illustrating a cutting example of adjustment pattern 113 provided in antenna 108 illustrated in FIG. 18. FIG. 20(*a*) is a diagram illustrating a cutting example of adjustment pattern 113 in a case where the inductance of antenna 108 illustrated in FIG. 18 is made the maximum inductance, and FIG. 20(*b*) is a diagram illustrating a cutting example of adjustment pattern 113 in a case where the inductance of antenna 108 illustrated in FIG. 18 is made the minimum inductance. FIG. 21 is a diagram illustrating examples of cutting positions of adjustment pattern 113 in lower-side flexible substrate 112*a* of antenna 108 illustrated in FIG. 17(*a*) that corresponds to antenna 108 that is schematically illustrated in FIG. 20.

As illustrated in FIG. 21, there are seven cutting positions of adjustment pattern 113 of lower-side flexible substrate 112*a* of antenna 108 according to the embodiment of the invention, namely, positions A to G. The cutting positions are on lead-out patterns v and on protrusion section lead-out pattern z that links an intersection point with divided pattern t and an intersection point with connection pattern win protrusion section y.

In adjustment pattern 113 of FIG. 21 that has these cutting positions, when making the overall inductance of antenna 108 the maximum inductance, as in the schematic diagram illustrated in FIG. 20(*a*), it is sufficient to cut cutting positions B to G in FIG. 21 and leave only cutting position A in a connected state. Similarly, when making the overall inductance of antenna 108 the minimum inductance, as in the schematic diagram illustrated in FIG. 20(*b*), it is sufficient to cut cutting positions A to F in FIG. 21 and not to cut cutting position G, so that only cutting position G is left in a connected state.

Thus, the inductance of antenna 108 of the embodiment of the claimed invention can be adjusted by making a position at which coil pattern f and adjustment pattern 113 are left in a connected state any one position among cutting positions A to G. That is, in coil pattern f illustrated in FIG. 18 and FIG. 20, a portion that is after a cutting position at which adjustment pattern 113 and divided pattern t constituting part of coil pattern f in FIG. 21 is outside of core 111. Furthermore, a portion that remains from that position on external connection terminal 108*b* side no longer contributes to formation of the inductance of antenna 108 illustrated in FIG. 18 and FIG. 20.

TABLE 4

| | Remaining connection position | | | | | | |
|---|---|---|---|---|---|---|---|
| | A | B | C | D | E | F | G |
| @ 13.56 MHz | 3.92 | 3.90 | 3.89 | 3.87 | 3.84 | 3.82 | 3.78 |
| Adjustable range | 3.85 ± 0.07 μH(±2%) | | | | | | |

Table 4 shows an example of measurement results with respect to the inductance of antenna 108 in cases where only one position among the respective cutting positions A to G illustrated in FIG. 21 was not subjected to cutting. In the antenna for which these measurement results were obtained, core 111 illustrated in FIG. 18 and FIG. 20 was constituted by ferrite with a size of 14.5×38×0.3 (thickness) mm, in which the number of turns of coil pattern f that was wound around core 111 was 10 turns. The initial inductance of antenna 108 in a case where cutting was not performed at any of cutting positions A to G illustrated in FIG. 21 was 3.74 μH. That is, Table 4 shows that in the case of an antenna whose initial inductance is 3.74 μH, the inductance of the antenna can be adjusted in a range of 3.85±0.07 μH (i.e. ±2%). Therefore, conversely, when the inductance that is the adjustment target is taken as 3.85 μH, if the initial inductance is distributed within the range of 3.74 μH±2%, the inductance can be adjusted to approximately 3.85 μH.

Thus, adjustment of the inductance of antenna 108 of the embodiment is performed by leaving only one position among cutting positions A to G and disconnecting all of the other cutting positions. Disconnection may be performed by stamping out the cutting position of the relevant portion by punching, or may be performed by burning away a conductive pattern at the cutting position of the relevant portion with a laser and/or the like. However, when a method utilizing a laser is employed it is possible to perform cutting rapidly, and the adjustment pattern 113 can be made compact since space for a bench or clamp that are required when performing punching are not needed.

Adjustment of inductance by cutting in this manner is an "all or nothing" process in which a cut portion can not be redone once cutting has been executed. For that reason, measurements may be performed and the distribution is ascertained on a large number of antennas 108 in advance to determine the extent of individual differences in the initial inductance of antennas 108 in a state in which no cutting has been performed. Furthermore, data may be accumulated in advance regarding how much the inductance changes when any of cutting positions A to G is left from the state in which no cutting has been performed. It is thus possible to first measure the initial inductance of antenna 108 in a state in which no cutting has been performed, and then determine with high accuracy which of cutting positions A to G may be left. Doing so can ultimately enhance the yield of antennas 108. In this connection, even if a cutting failure occurs, it is possible to further enhance the accuracy of cutting by feeding back that data into the accumulated measurement data.

Thus, irrespective of which of cutting positions A to G is selected as a position at which a connection between adjustment pattern 113 and divided pattern t of FIG. 21 that constitutes part of coil pattern f illustrated in FIG. 18 and FIG. 20 is left, the line length of coil pattern f illustrated in FIG. 18 and FIG. 20 is substantially constant. While that is the case, the line length of a portion wound around core 111 of coil pattern f changes depending on which of cutting positions A to G is left. Accordingly, the inductance of antenna 108 can be adjusted while the overall line length of coil pattern f illustrated in FIG. 18 and FIG. 20 is kept constant. In addition, in antenna 108 of the embodiment of the claimed invention, since adjustment pattern 113 is not provided within an opening of the coil pattern, the opening area does not change irrespective of what kind of cutting is performed. Consequently, since it is also difficult for a characteristic such as an overall Q factor of antenna 108 to change, variations in the performance of antenna 108 after inductance adjustment are small.

Figure 22:
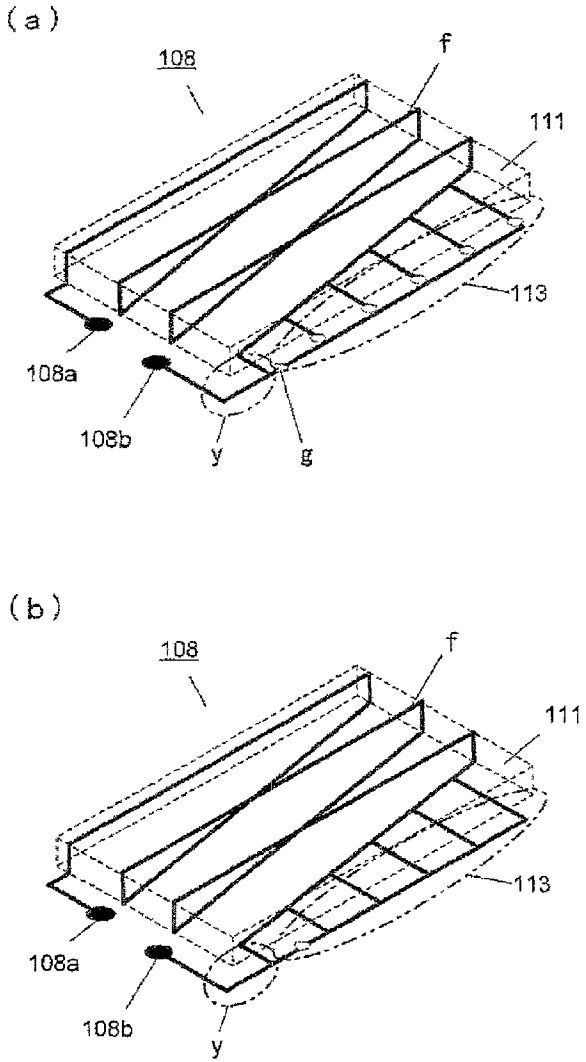
FIG. 22 is a diagram illustrating a cutting example of an adjustment pattern provided in the antenna of FIG. 18.
Figure 23:
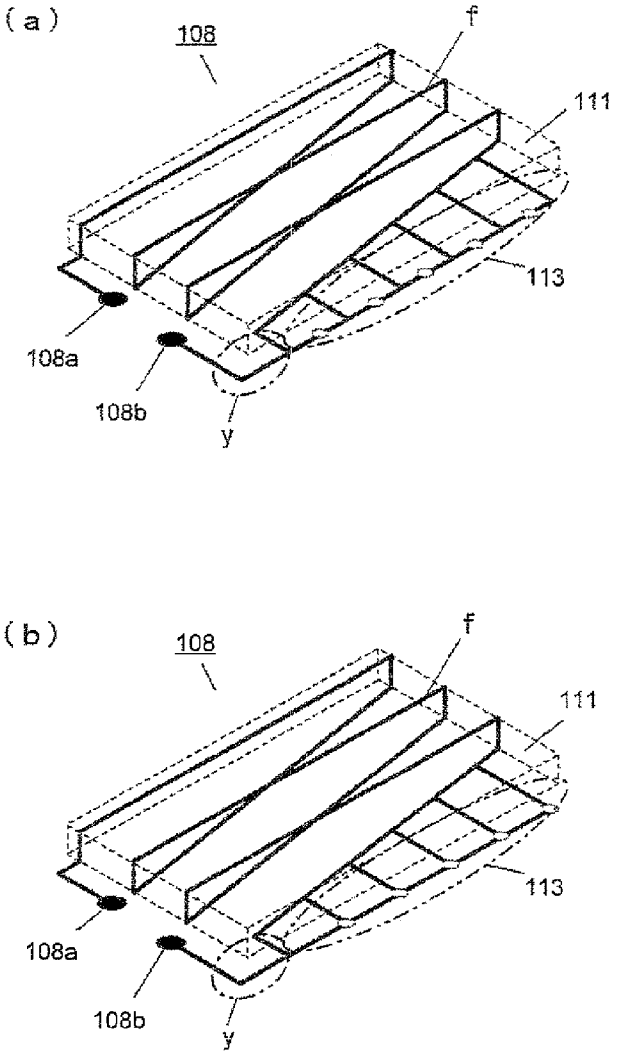
FIG. 23 is a diagram illustrating another cutting example of an adjustment pattern provided in the antenna of FIG. 18.

FIG. 22 and FIG. 23 are diagrams that show cutting examples for adjustment pattern 113 provided in antenna 8 illustrated in FIG. 18, which show different examples to that of FIG. 20.

Although FIG. 22(*a*) is a diagram that, similarly to FIG. 20(*a*), shows a cutting example of adjustment pattern 113 in a case where the inductance of antenna 108 illustrated in FIG. 18 is made a maximum inductance, compared to FIG. 20(*a*) the number of cutting positions is increased by one, namely, cutting position g. It is possible to prevent the influence of noise mixing in from around antenna 108 by means of cutting position g that is the increased position. Antenna 108 is mounted to, for example, portable terminal 1 as illustrated in FIG. 1, or to another apparatus. Accordingly, noise that is present around antenna 108 may include, for example, communication signals of a frequency (24 GHz) that portable terminal 1 uses as the main communication section, or a clock signal that is required for electronic circuit board 6 to operate.

Although FIG. 22(*b*) also illustrates a cutting example of adjustment pattern 113 in a case where the inductance of antenna 108 illustrated in FIG. 18 is made the maximum inductance, there is only a single cutting position. That is, in FIG. 21 that corresponds thereto, cutting is performed between intersection points of protrusion section lead-out pattern z in the protrusion section of coil pattern t or lead-out patterns v of adjustment pattern 113 and connection pattern w. There is thus the advantage that the time taken for inductance adjustment of antenna 108 is reduced and manufacturing can be performed with ease. However, according to this cutting example, there is a plurality of paths of a current that flows from one external connection terminal 108*a* to the other external connection terminal 108*b*. As a result, there is a possibility of unexpectedly receiving the influence of noise and/or the like that enters from around antenna 108 as described above. If that influence is not received, an adjustment method that employs the aforementioned cutting may be adopted.

In an adjustment method that employs the aforementioned cutting, when setting the inductance of antenna 108 to another value, it is sufficient to cut connection pattern w between two adjacent intersection points among the intersection points between lead-out patterns v and connection pattern w of adjustment pattern 113. For example, an adjustment method can be adopted in which cutting is performed in sequence from the right side of adjustment pattern 113 in FIG. 22(*b*), that is, in sequence from between the intersection points at which the inductance becomes the minimum inductance, and the cutting is stopped when the inductance enters the range of the specifications.

FIG. 23(*a*) is a diagram illustrating a cutting example in a case where the maximum inductance is obtained as a result of employing the above described adjustment method. Furthermore, FIG. 23(*b*) shows a case in which the inductance of antenna 108 is made the maximum inductance by cutting intersection points between lead-out patterns v and connection pattern w of adjustment pattern 113, which is a cutting example that is different to the examples described above.

Figure 24:
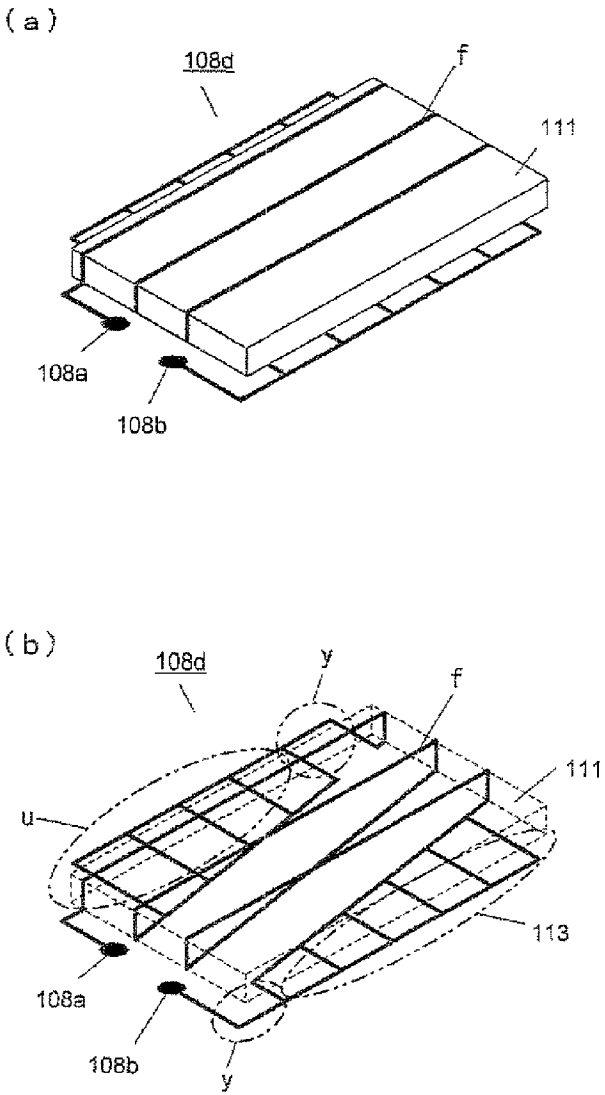
FIG. 24 is a perspective view illustrating an antenna according to Embodiment 2 of the claimed invention in which an adjustment pattern is provided on both sides of a core.

FIG. 24 is a perspective view illustrating an antenna according to Embodiment 2 of the claimed invention in which an adjustment pattern is provided on both sides of a core. By increasing the adjustment pattern in this manner, an adjustment range of an inductance of antenna 108*d* can also be increased. The adjustment range of the inductance of antenna 108*d* illustrated in FIG. 24 is approximately twice as large as that of antenna 108 illustrated in FIG. 18.

Figure 25:
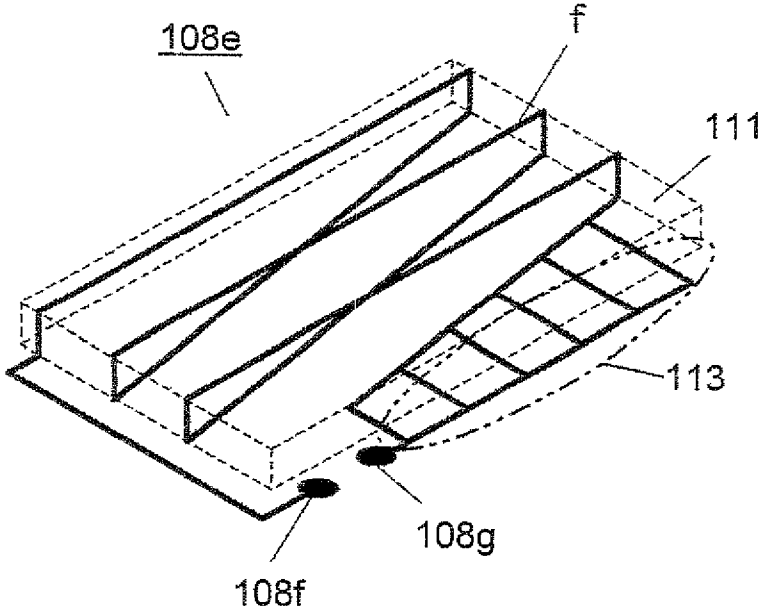
FIG. 25 is a perspective view of an antenna in which external connection terminals are disposed at different positions to the antenna illustrated in FIG. 18.

FIG. 25 is a perspective view of antenna 108*e* in which external connection terminals 108*f* and 108*g* are disposed at different positions to antenna 108 illustrated in FIG. 18. As long as the external connection terminals are at positions that are outside of the exterior of core 111 in this manner, the external connection terminals may be disposed at any position. Naturally, a lead-out pattern may be added and the external connection terminals may be provided at positions that are further away from core 111.

Note that although flexible substrate 112 according to the embodiment is constituted by two substrates, namely, lower-side flexible substrate 112*a* and upper-side flexible substrate 112*b*, a configuration may also be adopted in which the upper-side and lower-side substrates are joined and integrated, and then folded to assemble flexible substrate 112. For example, with, respect to flexible substrate 112 illustrated in FIG. 17, pattern exposing section 117*b* side of lower-side flexible substrate 112*a* and pattern exposing section 119*b* side of upper-side flexible substrate 112*b* are connected, and divided patterns are connected at that portion. As a result, although joining is performed between pattern exposing sections 117*a* and 117*b* of lower-side flexible substrate 112*a* and pattern exposing sections 119*a* and 119*b* of upper-side flexible substrate 112*b* in the configuration illustrated in FIG. 17, none of the joining is required for the embodiment. In other words, by adopting this configuration, the soldering locations can be reduced by half. In addition, apart from the aforementioned configuration, a configuration may also be adopted in which lower-side flexible substrate 112*a* and upper-side flexible substrate 112*b* are joined and integrated at a side face on a side opposite to a side on which adjustment pattern 113 is provided, and then folded to assemble flexible substrate 112. In this case, although the number of soldering locations does not decrease, ease of assembly is improved.

Although the above embodiment has been described with respect to antenna 108 having core 111 of a certain specific size and a prescribed number of turns, the application range of the claimed invention is not limited to the embodiment, and the claimed invention is applicable to antennas having cores of all sizes and all number of turns. However, the adjustable range of an inductance that can be adjusted with this kind of adjustment mechanism changes, depending on the number of turns of the coil. That is, when the number of turns is large, although the adjustable range decreases, the adjustment mechanism is suitable for fine adjustment. Conversely, when the number of turns is small, the adjustable range increases, and even if variations in the initial inductance are large, antennas with a stable inductance can be manufactured.

According to the claimed invention, since a small antenna that has a stable inductance value can be provided in which the communication characteristics of the antenna are maintained, the claimed invention is useful as an antenna, antenna apparatus and communication apparatus for various kinds of electronic equipment such as a cellular phone. The claimed invention can also be applied to uses such as a drug management system other than for storage cabinets or display shelves, a hazardous material management system, a valuables management system and/or the like for which, in particular, automatic merchandise management, book management and/or the like are enabled.

| Reference Signs List | |
|---|---|
| 1 | Portable terminal |
| 2 | Display panel |
| 3 | Back cover |
| 4 | Battery |
| 5 | Camera |
| 6 | Electronic circuit board |
| 7a, 7b | Antenna input/output pin |
| 8 | Antenna |
| 8a, 8b | External connection terminal |
| 9 | Antenna control section |
| 11 | Core |
| 12 | Flexible substrate |
| 12a | Lower-side flexible substrate |
| 12b | Upper-side flexible substrate |
| 13 | Adjustment pattern |
| 14a, 14b | Winding pattern |
| 17a, 17b | Pattern exposing section (lower side) |
| 19a, 19b | Pattern exposing section (upper side) |
| 31 | Coil section |
| 32, 33 | Antenna input/output terminal |

The invention claimed is:

1. An antenna comprising:

a magnetic core;

a coil winding section in which a conducting wire is wound around the magnetic core; and an adjustment section connected to one end of the coil winding section, wherein:

the adjustment section includes a plurality of adjustable conducting wires formed by dividing the conducting wire that is connected to the coil winding section, along with a longitudinal direction of the adjustment section, at an end portion of the magnetic core;

the plurality of adjustable conducting wires are connected with each other at both ends of the adjustable conducting wires;

a first adjustable conducting wire that is located nearest to the coil winding section, of the plurality of adjustable conducting wires, is connected to an end of the conducting wire without via a cutting point; and an adjustable conducting wire other than the first adjustable conducting wire is connected to the end of the conducting wire via the cutting point.

2. The antenna according to claim 1, wherein an inductance is adjusted by cutting only any one of cutting points.

3. The antenna according to claim 1, wherein the cutting point is located such that the cutting point does not overlap with the magnetic core.

4. The antenna according to claim 1, wherein a longitudinal direction of the adjustment section is substantially perpendicular to a winding axis of the coil winding section.

5. The antenna according to claim 1, wherein the plurality of adjustable conducting wires and the conducting wire of the coil winding section are substantially in parallel with each other.

6. The antenna according to claim 1, wherein among the plurality of adjustable conducting wires in the adjustment section, an adjustable conducting wire closest to the coil winding section is thicker than another adjustable conducting wire.

7. The antenna according to claim 6, wherein a width of the adjustable conducting wire closest to the coil winding section is identical with a width of the conducting wire of the coil winding section.

8. The antenna according to claim 1, wherein a space between the conducting wires in the coil winding section is larger than a space between the conducting wires in the adjustment section.

9. The antenna according to claim 1, wherein the magnetic core is plate-shaped and provided with the coil winding section on both surfaces of the magnetic core.

10. The antenna according to claim 1, wherein:

the coil winding section comprises a first flexible substrate and a second flexible substrate on each of which a conducting wire is formed, and the coil winding section is funned by connecting the conducting wires with each other; and the first flexible substrate and the second flexible substrate hold the magnetic core in between in such a way as to cover the magnetic core.

11. An antenna apparatus comprising:

a metal body; and the antenna according to claim 1, wherein the antenna and the metal body are adjacently disposed in a state of being in contact with each other or not being in contact with each other.

12. The antenna apparatus according to claim 11, wherein at least part of the antenna faces the metal body.

13. The antenna apparatus according to claim 11, wherein:

at least part of the coil winding section faces the metal body; and at least part of the adjustment section does not face the metal body.

14. The antenna apparatus according to claim 11, wherein an opening of the coil winding section is perpendicular to a region of the metal body that faces the antenna.

15. A communication apparatus comprising the antenna apparatus according to claim 11.

* * * * *